US010863803B2

(12) United States Patent
Strum et al.

(10) Patent No.: US 10,863,803 B2
(45) Date of Patent: Dec. 15, 2020

(54) COMPACT FOLDING CANE

(71) Applicant: Michael Graves Design Group, Inc., Princeton, NJ (US)

(72) Inventors: Donald Strum, Princeton, NJ (US); Robert Beale Van Varick, Princeton, NJ (US); Matthew Mead Schmitt, Princeton, NJ (US); Vladimir Anokhin, Princeton, NJ (US); William Robert Parcells, Princeton, NJ (US)

(73) Assignee: MICHAEL GRAVES DESIGN GROUP, INC., Princeton, NJ (US)

( * ) Notice: Subject to any disclaimer, the term of this patent is extended or adjusted under 35 U.S.C. 154(b) by 0 days.

(21) Appl. No.: 16/495,019

(22) PCT Filed: Mar. 23, 2018

(86) PCT No.: PCT/US2018/023990
§ 371 (c)(1),
(2) Date: Sep. 17, 2019

(87) PCT Pub. No.: WO2018/175866
PCT Pub. Date: Sep. 27, 2018

(65) Prior Publication Data

US 2020/0008545 A1 Jan. 9, 2020

Related U.S. Application Data

(60) Provisional application No. 62/476,117, filed on Mar. 24, 2017.

(51) Int. Cl.
*A45B 9/00* (2006.01)
*A45B 19/08* (2006.01)
(Continued)

(52) U.S. Cl.
CPC ..... *A45B 9/00* (2013.01); *A45B 9/02* (2013.01); *A45B 9/04* (2013.01); *A45B 19/08* (2013.01);
(Continued)

(58) Field of Classification Search
CPC ..... A45B 19/08; A45B 2009/005; A45B 9/00
See application file for complete search history.

(56) References Cited

U.S. PATENT DOCUMENTS 1,336,638 A 4/1920 Kutwicz
1,396,372 A 11/1921 Kutwicz
(Continued)

FOREIGN PATENT DOCUMENTS

FI 118454 11/2007
JP 2010-124920 A2 6/2010

OTHER PUBLICATIONS

PCT Application No. PCT/US2018/023990 , International Preliminary Report on Patentability, dated Oct. 3, 2019, 10 pages.
(Continued)

*Primary Examiner* — Noah Chandler Hawk
(74) *Attorney, Agent, or Firm* — Kilpatrick Townsend & Stockton LLP

(57) ABSTRACT

A compact and collapsible cane includes a handle, a tip, and at least two collapsible cane segments joining the handle to the tip. In some aspects, the cane segments are configurable in an unfolded configuration and a folded configuration, where, in the folded configuration, a flat or nesting surface of one of the cane segments abuts a corresponding flat or nesting surface of an adjacent cane segment. In various examples, the collapsible cane includes a hinge with two parallel pivot axes between the two collapsible cane segments. In some examples, the cane includes a connector system with a male connector and a female connector
(Continued)

connected by a shock cord between the two collapsible cane segments.

6 Claims, 19 Drawing Sheets

(51) Int. Cl.
*A45B 9/02* (2006.01)
*A45B 9/04* (2006.01)

(52) U.S. Cl.
CPC ... *A45B 2009/002* (2013.01); *A45B 2009/007* (2013.01); *A45B 2009/025* (2013.01)

(56) References Cited

U.S. PATENT DOCUMENTS 2,409,452 A * 10/1946 Stone ..... A45B 9/00 403/99
4,253,478 A 3/1981 Husa
4,437,480 A * 3/1984 Husa ..... A61H 3/02 135/74
4,527,579 A 7/1985 Knotter et al.
4,763,680 A * 8/1988 Acosta, Sr. ..... A61H 3/02 135/68
5,139,283 A * 8/1992 Dow ..... A63C 11/221 135/72
5,178,583 A * 1/1993 Rankin ..... B64G 9/00 403/100
7,003,849 B2 2/2006 Cohen et al.
7,048,635 B1 5/2006 Porper
7,841,353 B2 * 11/2010 Lee ..... A45B 9/00 135/74
8,985,130 B2 * 3/2015 Howarth ..... A45B 9/00 135/74
9,456,671 B2 * 10/2016 Crowhurst ..... A45B 9/04
9,915,081 B2 * 3/2018 Sosnowski ..... E04H 15/48
10,492,577 B2 * 12/2019 Ritter ..... A45B 9/02
2014/0069475 A1 3/2014 Lenhart

OTHER PUBLICATIONS

PCT Application No. PCT/US2018/023990 , International Search Report and Written Opinion, dated Jun. 25, 2018, 11 pages.

* cited by examiner

COMPACT FOLDING CANE

FIELD OF THE INVENTION

This patent is for a compact folding cane.

BACKGROUND

Conventional folding canes include an elongated, round shaft that separates into segments with a ground engaging foot at one end, and a handle for grasping at an opposite end. Conventional folding canes like these have numerous drawbacks. For example, most conventional folding canes use round tubing for the shaft. When the conventional folding cane is in the folded-up position, the tube segments become hard to organize and are difficult to store in a tight, neat manner. In an attempt to provide minimal order, conventional folding canes often rely on an elastic strap that is difficult for users to utilize. Conventional folding canes are also inconvenient to fold-up, needing multiple steps and redundant efforts. Accordingly, there exists a need for an improved folding cane.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

In some aspects, disclosed is an improved folding cane. In some examples, the folding cane can be compact, convenient to fold-up, and easy to use while being stylish, providing assistance to the user while instilling confidence. For example, the improved folding cane may be aesthetically more pleasing. In certain examples, the folding cane provides orderly storage when folded up. In various examples, the folding cane may provide the consumer or user the ability to interchange feet to improve safety, extend lifecycle of the folding cane, and to meet the demands of a given environment or use. Further, an improved folding cane may better conform to the environment in which it is used.

In various examples, a folding cane includes a handle, a tip, and at least two collapsible cane segments joining the handle to the tip. The cane segments are configurable in an unfolded configuration and a folded configuration, where, in the folded configuration, a flat or nesting surface of one of the cane segments abuts a corresponding flat or nesting surface of an adjacent cane segment.

In some examples, a collapsible cane includes a handle, a tip, at least two collapsible cane segments joining the handle to the tip, and a hinge with two parallel pivot axes between the two collapsible cane segments. The cane segments are configurable between an unfolded configuration and a folded configuration by moving the cane segments apart from one another to expose a portion of the hinge, and rotating the cane segments relative to one another about the two pivot axes.

In certain examples, a collapsible cane includes a handle, a tip, at least two collapsible cane segments joining the handle to the tip, and a connector system between the two collapsible cane segments. The connector system includes a male connector and a female connector connected by a shock cord, and the female connector includes a shock cord notch. The cane segments are configurable between an unfolded configuration and a folded configuration by moving the cane segments apart from one another to remove the male connector from the female connector, and rotating the cane segments relative to one another such that a portion of the shock cord is positioned in the shock cord notch.

In various aspects, a compact folding cane can include an ergonomically shaped handle for a comfortable and stable grip. The handle can include a built in strap that can be placed around the wrist of the user when the cane is in its unfolded position and can be used to neatly organize the cane when it is in its folded-up position. The compact folding cane optionally may also contain a shaft including at least two cane segments that can be easily separated by one motion when the compact folding cane is pulled from both directions. The cane segments each include at least one nesting surface that will enable the cane segments to store compactly and neatly when folded up. The compact folding cane can further include a foot for engaging the ground. The foot can be coupled to the shaft and easily removed by pressing a groove on the foot. The compact folding cane can come in four sizes to accommodate a full range of consumer heights without the need for height adjustment mechanisms.

Each cane segment of the compact folding cane shaft may be connected to another segment by a hinge. In certain cases, the compact folding cane can fold flat with the use of the hinges. The hinges optionally can also prevent or reduce over-extension of the cane segments. Optionally, magnets can be included with the cane segments to hold and organize the cane segments while in the folded position. The handle can optionally fold down using a similar hinge mechanism to provide additional compactness. In some examples, tension from an elastic shock-cord or other suitable flexible member can enable the handle shank to act as an over-center lock to hold the handle folded at a desired angle, including but not limited to 90 degrees. Secondary shock cords can prevent the shock cords from over extending. The wrist strap can be wrapped around the folded segments of the compact folding cane shaft and then snap into the end of the handle for additional latch security.

In other examples, instead of or in addition to the hinge, each segment of the folding cane is connected to another segment through a connector system including a male connector, a female connector, and a shock cord.

In some cases, the lowest cane segment of the compact folding cane includes a foot anchor with a recessed groove that is configured to engage a protrusion inside the foot in order to create a secure connection that can also be easily removed by pressing the groove on the foot when desired. In various aspects, the foot is self-standing such that the folding cane stands upright on flat ground. In certain cases, the foot partially nests with one of the cane segments through the groove on the foot.

According to certain examples, a compact and collapsible cane includes a handle, a tip, and at least two collapsible cane segments joining the handle to the tip. In various aspects, the cane segments are configurable in an unfolded configuration and a folded configuration, where, in the folded configuration, a flat or nesting surface extending along a portion of one of the cane segments abuts a corresponding flat or nesting surface extending along a portion of an adjacent cane segment.

In some examples, the cane segments have non-circular cross-sectional profiles. In various cases, the cross-sectional profiles of the cane segments each include at least one flat surface extending along a portion of each cane segment.

According to various examples, the cane may, in some instances, also include a hinge with two parallel pivot axes between the two collapsible cane segments. In some examples, the cane segments are configurable between the unfolded configuration and the folded configuration by moving the cane segments apart from one another to expose a portion of the hinge, and rotating the cane segments relative to one another about the two pivot axes. In various cases, the hinge is a first hinge, and the cane may further include a second hinge with one of the two collapsible cane segments opposite from the first hinge, and the first hinge is connected to the second hinge through an elastic member. In certain cases, the cane further includes a magnet with each of the two collapsible cane segments, where the magnets are positioned such that they are magnetically engaged in the folded configuration. According to some cases, the tip includes a removable foot with a groove configured to receive a portion of one of the at least two collapsible cane segments in the folded configuration such that the removable foot nests with the one of the at least two collapsible cane segments.

According to various examples, a collapsible cane includes a handle, a tip, at least two collapsible cane segments joining the handle to the tip, and a hinge with two parallel pivot axes connecting the two collapsible cane segments. The cane segments are configurable between an unfolded configuration and a folded configuration by moving the cane segments apart from one another, and rotating the cane segments relative to one another about the two pivot axes.

In some examples, the cane segments are configurable between the unfolded configuration and the folded configuration by moving the cane segments apart from one another to expose a portion of the hinge, and rotating the cane segments relative to one another about the two pivot axes.

In certain aspects, in the folded configuration, a flat or nesting surface of one of the cane segments abuts a corresponding flat or nesting surface of an adjacent cane segment. The flat or nesting surface extends along a portion of the cane segment. In some examples, the flat or nesting surface extends along an entire length of the cane segment. In various aspects, the hinge is a first hinge, and wherein the compact and collapsible cane further comprises a second hinge with one of the two collapsible cane segments opposite from the first hinge, and wherein the first hinge is connected to the second hinge through an elastic member.

In some examples, in the unfolded configuration, a portion of the hinge is housed in one of the at least two collapsible cane segments. In various aspects, in the unfolded configuration, a portion of the hinge is housed in both of the at least two collapsible cane segments. In certain cases, one of the at least two collapsible cane segments includes a locking collar, the locking collar includes at least one locking tab, and the hinge includes at least one locking notch configured to engage the at least one locking tab in the folded configuration. In various cases, in the unfolded configuration, the at least two collapsible cane segments are aligned alone a cane axis, and the handle is rotatable about the cane axis.

According to certain examples, a collapsible cane includes a handle, a tip, at least two collapsible cane segments joining the handle to the tip, and a connector system between the two collapsible cane segments. The connector system includes a male connector, a female connector, and an elastic member, and the female connector includes at least one elastic member notch. The cane segments are configurable between an unfolded configuration and a folded configuration by moving the cane segments apart from one another to remove the male connector from the female connector, and rotating the cane segments relative to one another while a portion of the elastic member is positioned in the notch.

In various aspects, in the folded configuration, a flat or nesting surface of one of the cane segments abuts a corresponding flat or nesting surface of an adjacent cane segment. In certain examples, the male connector further includes at least one anti-rotation protrusion, and, in the unfolded configuration, the protrusion is positioned in the notch. In some examples, the handle defines a handle cavity, and, in the folded configuration, a portion of one of the at least two collapsible cane segments is positioned within the handle cavity. In various examples, the tip includes a removable foot, and the removable foot includes a groove configured to receive a portion of one of the at least two collapsible cane segments in the folded configuration such that the removable foot nests with the one of the at least two collapsible cane segments. According to some aspects, the shock cord notch is a first shock cord notch, the female connector includes a plurality of shock cord notches, and a portion of the shock cord is positioned in one of the shock cord notches in the folded configuration.

In some cases, the hinge is a first hinge, the cane further includes a second hinge at an end of one of the cane segments opposite from the first hinge, and an elastic member connects the first hinge to the second hinge. In various aspects, at least one of the cane segments includes a magnet configured to facilitate retaining the cane in the folded configuration. In some examples, at least one of the cane segments includes a magnet configured to facilitate retaining the cane in the folded configuration.

According to certain examples, a collapsible cane includes a handle, a tip, at least two collapsible cane segments joining the handle to the tip, and a connector system between the two collapsible cane segments. The connector system includes an anti-rotation system. The cane segments are configurable between an unfolded configuration and a folded configuration by moving the cane segments apart from one another and rotating the cane segments relative to one another, and, in the unfolded configuration, the anti-rotation system maintains an angular position of one of the cane segments relative to an adjacent cane segment.

In certain cases, the connector system includes a male connector, a female connector, and an elastic member, the female member includes at least one locking notch, the male connector further includes at least one anti-rotation protrusion, and, in the unfolded configuration, the protrusion is positioned in the notch.

According to various aspects, a compact and collapsible cane includes a collapsible handle, a tip, and at least two collapsible cane segments joining the handle to the tip. The cane segments and handle are configurable between an unfolded configuration and a folded configuration by moving the cane segments apart from one another, rotating the cane segments relative to one another, and rotating the handle relative to one of the cane segments.

According to certain embodiments, a compact and collapsible cane includes a collapsible handle, a tip, and at least three collapsible cane segments joining the handle to the tip. The cane segments, are configurable between an unfolded configuration and a folded configuration by moving the cane segments apart from one another with a single linear motion, and rotating the cane segments relative to one another. In some examples, the single linear motion is along an axis of the cane segments.

According to various embodiments, a compact and collapsible cane includes, a handle, a tip, and at least two collapsible cane segments joining the handle to the tip. The cane segments configurable in an unfolded configuration and a folded configuration, where, in the folded configuration, a flat or nesting surface extending along a portion of one of the cane segments abuts a corresponding flat or nesting surface extending along a portion of an adjacent cane segment.

According to various cases, a collapsible cane includes a handle, a tip, at least two collapsible cane segments joining the handle to the tip, and a connecting system connecting the at least two collapsible cane segments, connecting system foldable in at least two planes. The cane segments are configurable between an unfolded configuration and a folded configuration by moving the cane segments apart from one another, and rotating the cane segments relative to one another with the connecting system.

According to some examples, a collapsible cane includes a handle, a tip, at least two collapsible cane segments joining the handle to the tip, and a connector system between the two collapsible cane segments, the connector system including a male connector, a female connector, and an elastic member. The female connector includes at least one elastic member notch. The cane segments are configurable between an unfolded configuration and a folded configuration by moving the cane segments apart from one another to remove the male connector from the female connector, and rotating the cane segments relative to one another while a portion of the elastic member is positioned in the notch.

According to certain cases, a collapsible cane includes a handle, a tip, at least two collapsible cane segments joining the handle to the tip, and a connector system between the two collapsible cane segments, the connector system including an anti-rotation system. The cane segments are configurable between an unfolded configuration and a folded configuration by moving the cane segments apart from one another and rotating the cane segments relative to one another, and, in the unfolded configuration, the anti-rotation system maintains an angular position of one of the cane segments relative to an adjacent cane segment.

According to some examples, a compact and collapsible cane includes a collapsible handle, a tip, and at least two collapsible cane segments joining the handle to the tip. The cane segments and handle are configurable between an unfolded configuration and a folded configuration by moving the cane segments apart from one another, rotating the cane segments relative to one another, and rotating the handle relative to one of the cane segments.

According to various aspects, a compact and collapsible cane includes a collapsible handle, a tip, and at least three collapsible cane segments joining the handle to the tip. The cane segments, are configurable between an unfolded configuration and a folded configuration by moving the cane segments apart from one another with a single linear motion, and rotating the cane segments relative to one another.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "left," "right," "front," and "back," among others are intended to refer to the orientation as illustrated and described in the description (or figures) to which the components and directions are referencing. References herein to "consisting of" may, in at least some circumstances, encompass "consisting essentially of" or "comprising."

FIGS. 1-11C illustrate a first example of a folding cane 100. The folding cane 100 includes a handle 102, a tip 104, and at least two collapsible cane segments 106 joining the handle 102 to the tip 104. As illustrated in FIGS. 2A-B, the folding cane 100 is configurable between an unfolded configuration (FIG. 2A) and a folded configuration (FIG. 2B).

Referring to FIGS. 1, 2A-C, 3, 4, 8, and 10, the folding cane 100 includes at least two cane collapsible segments 106 but could include more as desired. For example, in FIG. 1, the folding cane 100 includes three cane segments 106A-C; however, in other examples, any desired number of cane segments may be included (e.g., two cane segments, three cane segments, four cane segments, five cane segments, etc.).

Figure 1:
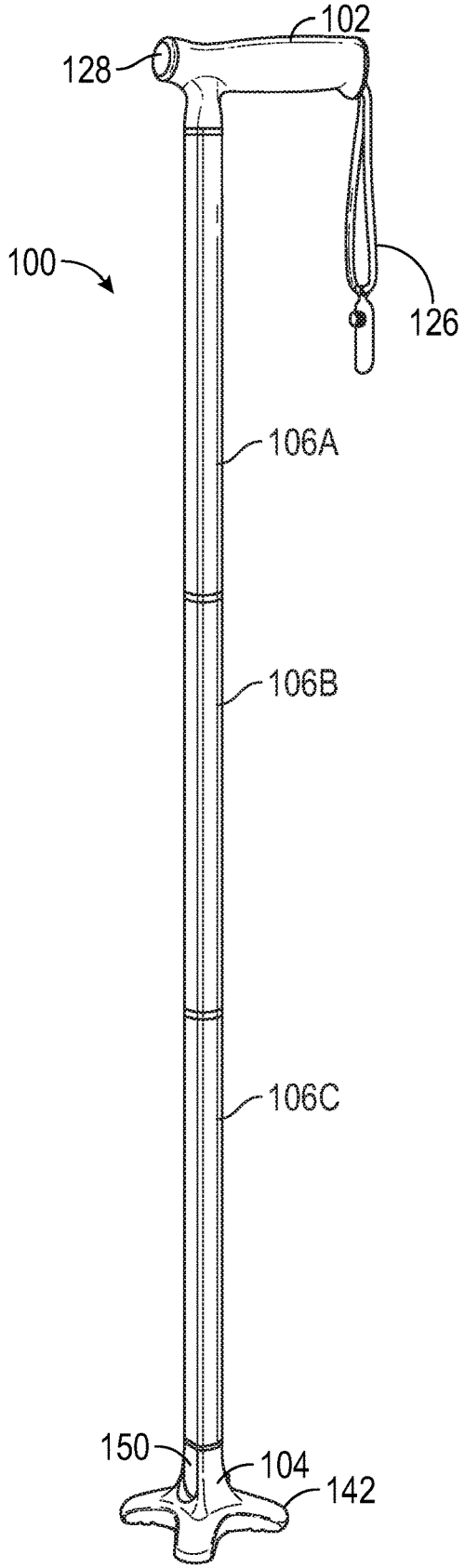
FIG. 1 is a perspective view of a folding cane according to aspects of the current disclosure.
Figure 2A:
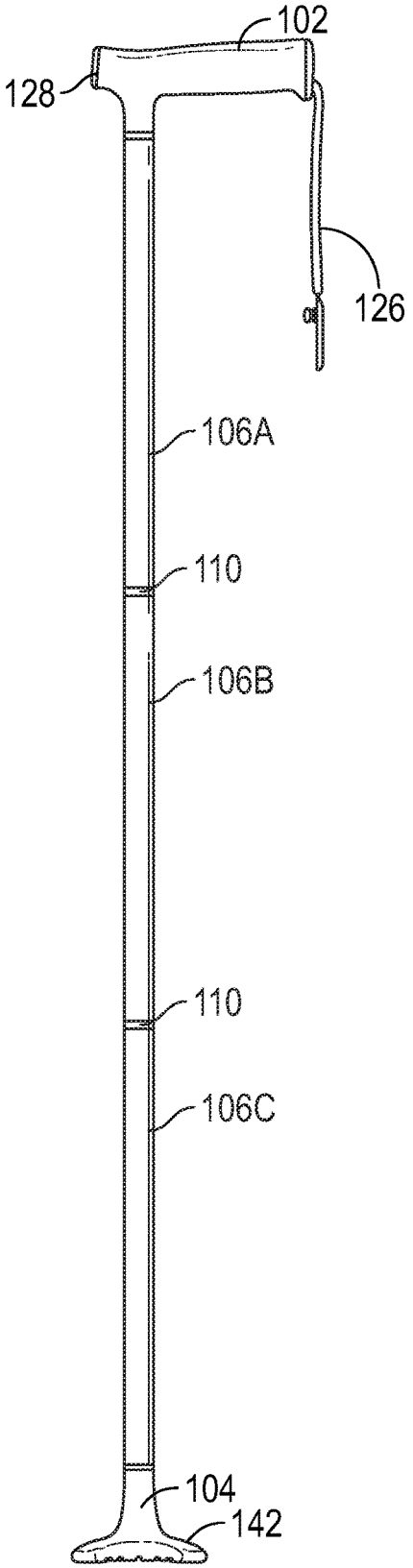
FIG. 2A is a side view of the folding cane of FIG. 1 in an unfolded configuration.
Figure 2B:
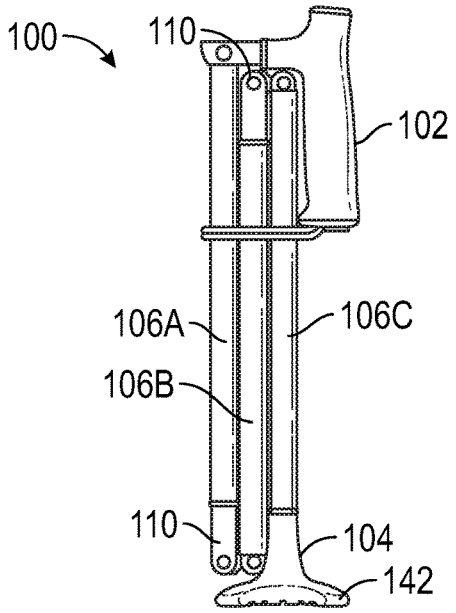
FIG. 2B is a side view of the folding cane of FIG. 1 in a folded configuration.
Figure 2C:
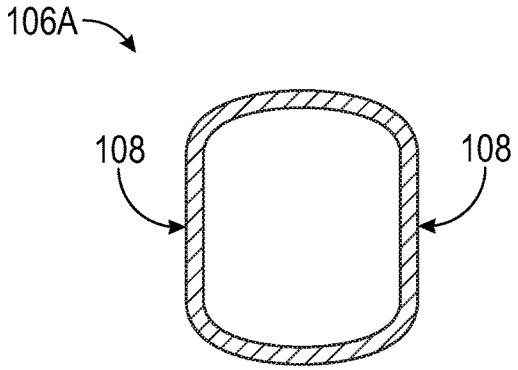
FIG. 2C is a sectional view of a segment of the folding cane of FIG. 1.
Figure 3:
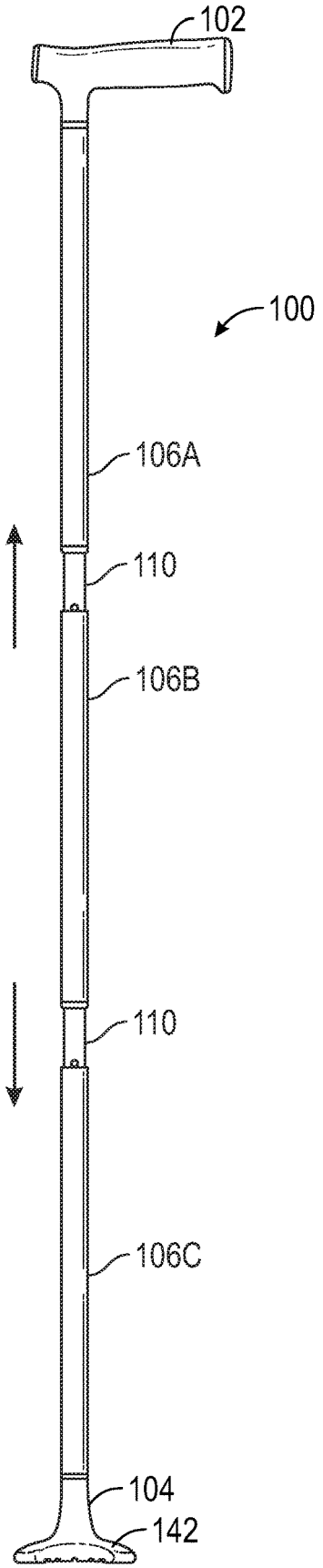
FIG. 3 is a side view of the folding cane of FIG. 1 in an unlocked position of the unfolded configuration.
Figure 12A:
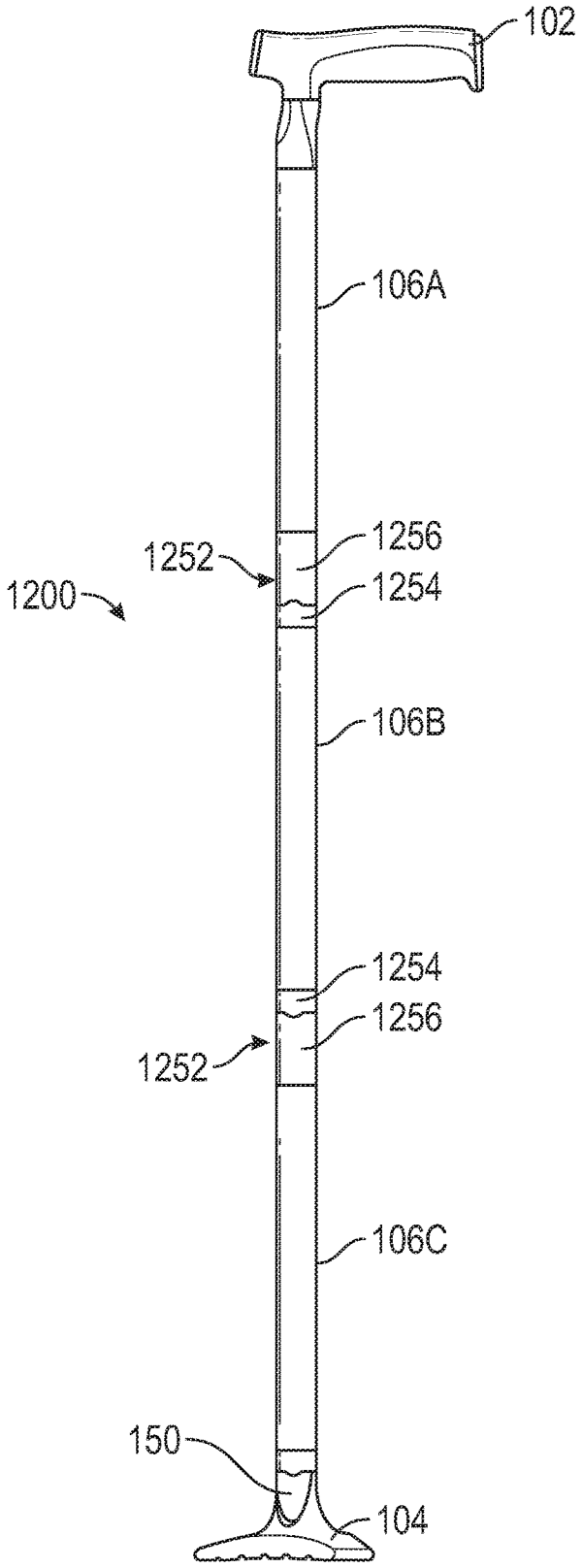
FIG. 12A is a side view of a folding cane according to aspects of the current disclosure in an unfolded configuration.
Figure 12B:
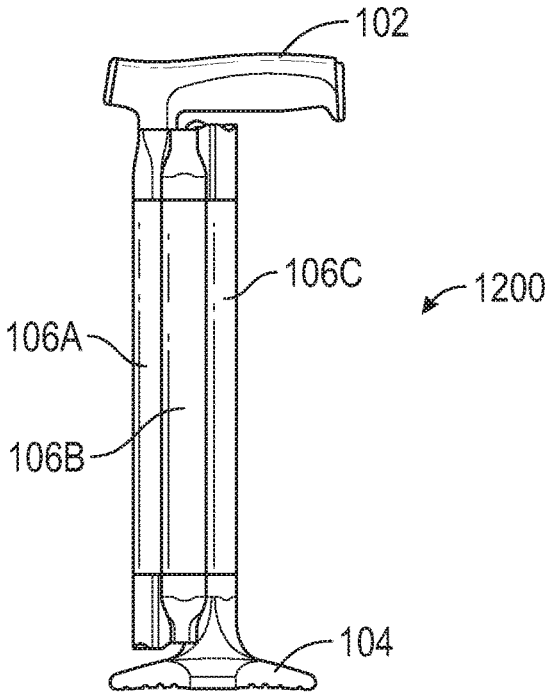
FIG. 12B is a side view of the folding cane of FIG. 12A in a folded configuration.
Figure 12C:
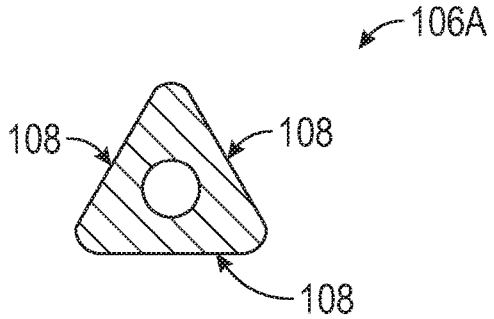
FIG. 12C is a sectional view of a segment of the folding cane of FIG. 12A.

As shown in FIG. 2C, the cane segment 106 includes at least one flat or nesting surface 108, and in some cases may include more than one nesting surface 108 (e.g., two nesting surfaces 108 as illustrated in FIG. 2C, three nesting surfaces 108 as illustrated in FIG. 12C, etc.). The flat or nesting surface 108 includes a surface that is mostly flat or a surface that has radiused or otherwise non-flat corners or edges. The flat or nesting surface 108 extends along a portion of the cane segment 106. In some examples, the flat or nesting surface 108 extends along an entire length of the cane segment 106, although it need not in other examples. In various examples, the nesting surface 108 of one cane segment 106 abuts the nesting surface 108 of another cane segment 106 in the folded configuration. In some examples, the nesting surfaces 108 predefine the engagement position of adjacent cane segments 106 and optionally allows for the cane segments 106 to be self-aligning in the folded configuration. In various aspects, with the at least one nesting surface 108, each cane segment has a non-circular cross-sectional profile. In some cases, the cross-sectional profile of each cane segment includes at least one flat surface, although it need not. For example, in other embodiments, the nesting surface 108 on adjacent cane segments 106 may be complimentary in shape such that the nesting surface 108 of one cane segment 106 can abut the nesting surface 108 of the adjacent cane segment 106.

In the example of FIGS. 1-11C, a connecting system for connecting adjacent cane segments includes a hinge 110 (i.e., adjacent cane segments 106 are connected through the hinge 110). In other examples, adjacent cane segments 106 may be connected through various other mechanisms including, but not limited to, connecting systems with a male connector, female connector, and elastic band, shock or bungee cords, uni-directional hinges, multi-directional hinges, barrel-lock systems, flexible hinges with no pivot points, a connecting system with multiple pivot points, a single pivot, or various other suitable mechanisms. Similarly, the handle 102 may also be connected to a cane segment 106 (e.g., cane segment 106A) through a hinge 110. In certain cases, the connecting system allows for adjacent cane segments 106 to be movable in at least two planes. In various examples, the hinge includes two parallel pivot axes 112A-B (see FIG. 4); however, in other examples, the hinge may include a single pivot axis or more than two pivot axes. In some examples, a first portion of the hinge 110 is at a fixed position relative to one of the cane segments 106 (e.g., cane segment 106A), and a second portion of the hinge 110 is movable relative to the other cane segment 106 (e.g., cane segment 106B). In certain cases, as illustrated in FIG. 2A, a majority of the hinge 110 (e.g., the portion of the hinge 110 with the two parallel pivot axes 112A-B) is housed within adjacent segments 106 and a minor portion of the hinge 110 (e.g., a positioning ridge) remains visible in the unfolded position. In other aspects, the entire hinge 110 is optionally concealed within the segments 106 in the unfolded position, although it need not be in other examples. In certain aspects, the segments 106 are movable to the folded position by moving the cane segments 106 apart such that a portion of the hinge 110 is exposed, and then rotating the cane segments 106 relative to each other about the pivot axes 112A-B (see FIGS. 2B and 3).

In certain examples, the hinges 110 may be uni-directional (i.e., the hinges 110 can only fold in one direction) or multi-directional. In some examples, the adjacent hinges 110 (or hinges at opposing ends of a cane segment 106) are interconnected through an elastic member 114 (e.g., shock cords) or other suitable members that allow for movement of the cane segments 106 between the folded and unfolded configurations. In such cases, the hinge 110 may include a slot or other suitable feature for connecting the hinge 110 to the elastic member 114 (see, e.g., FIGS. 4 and 8). In some optional examples, a lower-most cane segment 106 (e.g., cane segment 106C) includes a foot anchoring member 120 and the handle 102 includes a handle anchoring member 122 (see FIG. 9). In such examples, the system of hinges 110 and elastic members 114 extends from the foot anchoring member 120 to the handle anchoring member 122.

Figure 4:
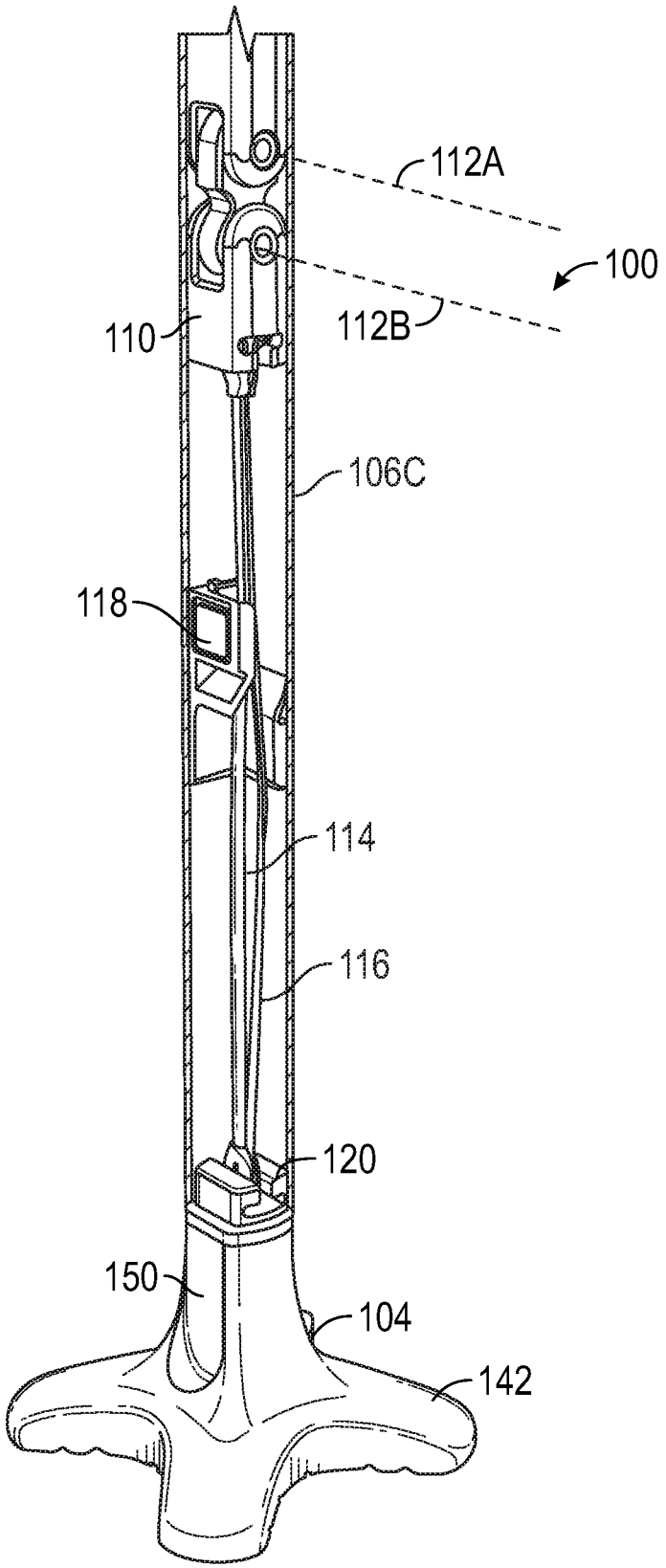
FIG. 4 is a perspective view of a portion of the folding cane of FIG. 1.
Figure 8:
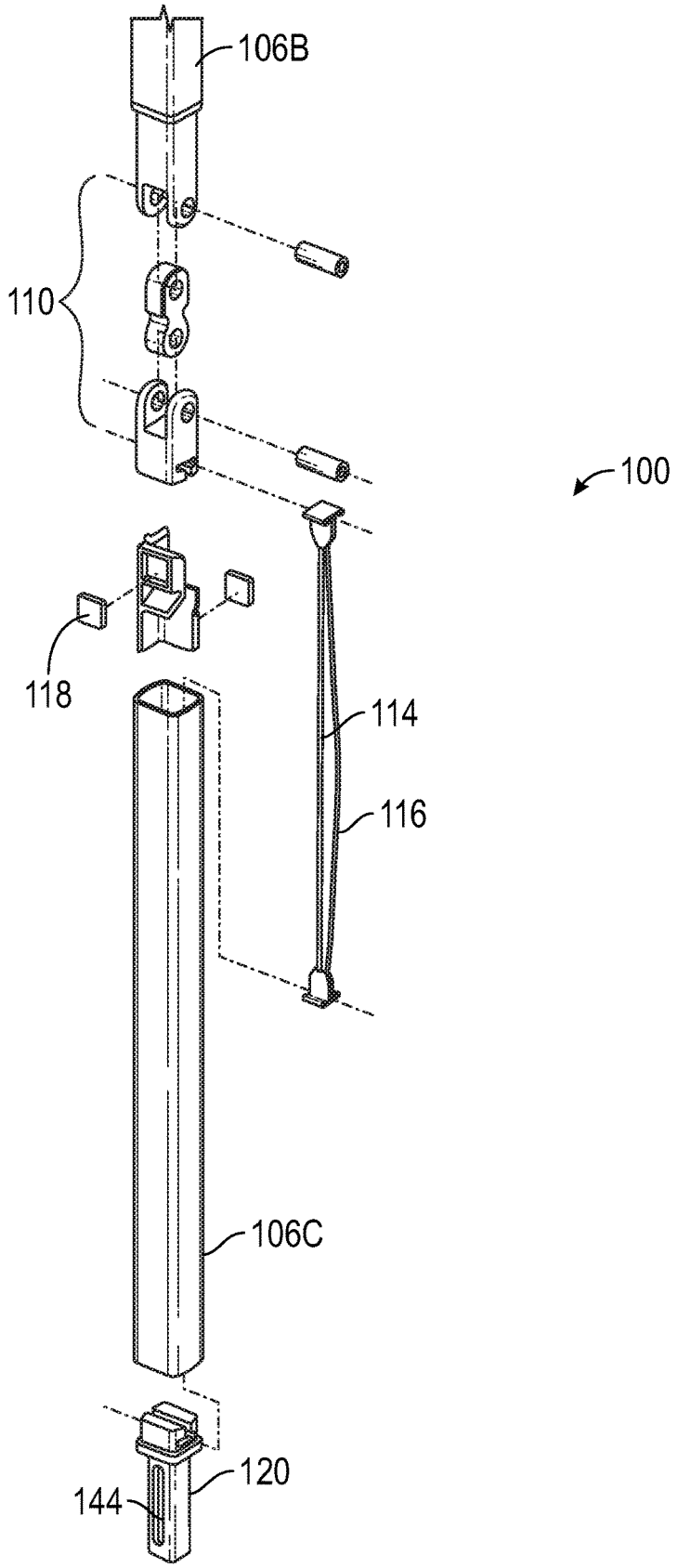
FIG. 8 is an exploded assembly view of a portion of the folding cane of FIG. 1.
Figure 10:
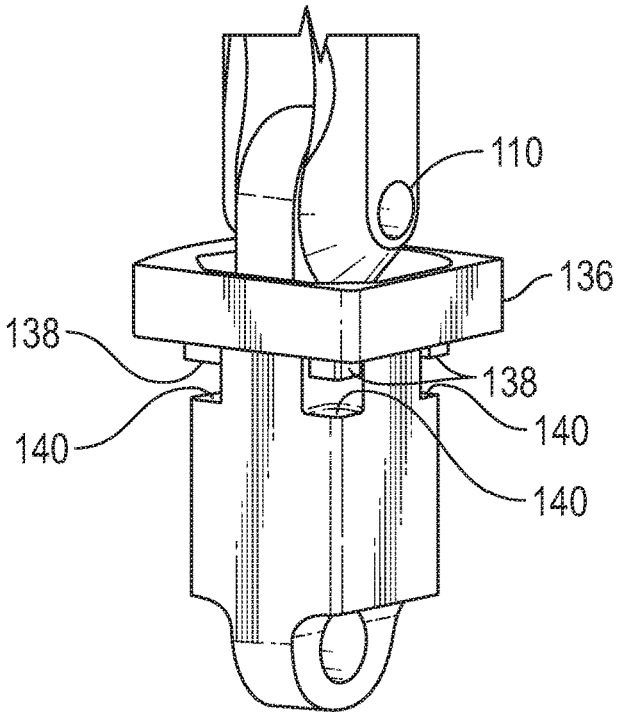
FIG. 10 is a perspective view of a portion of a hinge joint according to aspects of the current disclosure that can be used with the folding cane of FIG. 1.

Optionally, as illustrated in FIGS. 4 and 8, a secondary elastic member 116 may be provided to prevent over-extension of the elastic member 114. In other optional examples as illustrated in FIG. 10, a locking collar 136 that is attachable to an end of one of the cane segments 106 includes one or more locking tabs 138 that are configured to engage corresponding grooves 140 of the hinge 110 (or vice versa). Optionally, adjacent cane segments 106 may include magnets 118 (see, e.g., FIG. 4). In the folded configuration, the magnets 118 of the adjacent cane segments 106 are configured to interact and aid in retaining the cane segments 106 in the folded configuration.

Figure 11A:
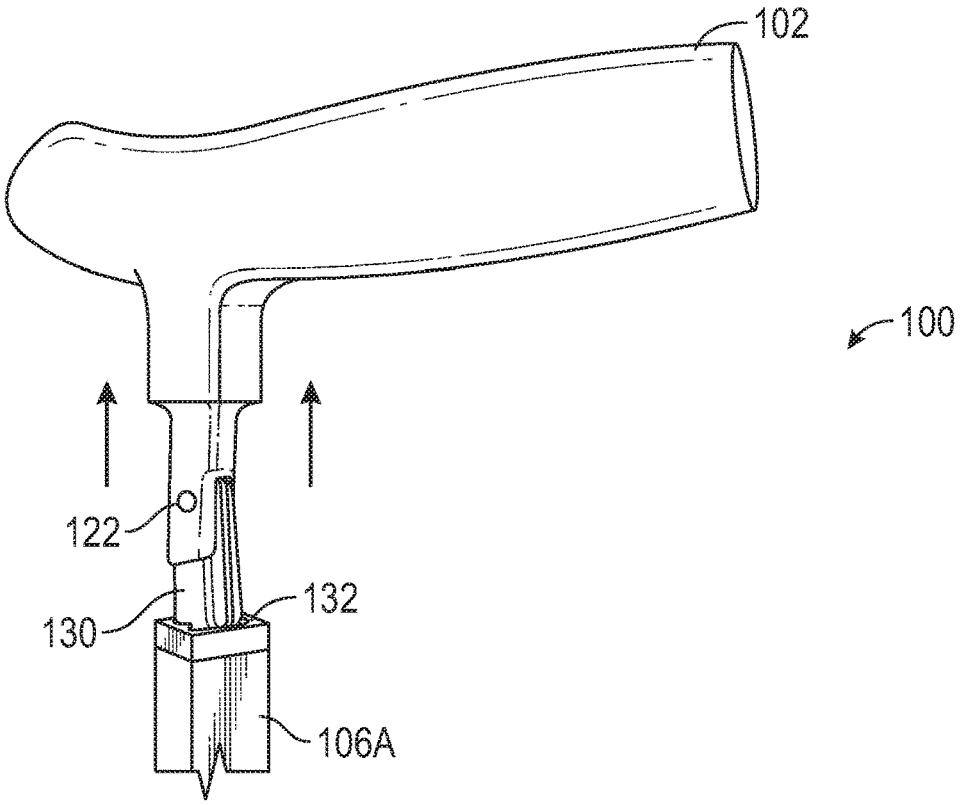
FIG. 11A is a perspective view of a handle of the folding cane of FIG. 1 in the unlocked position.
Figure 11B:
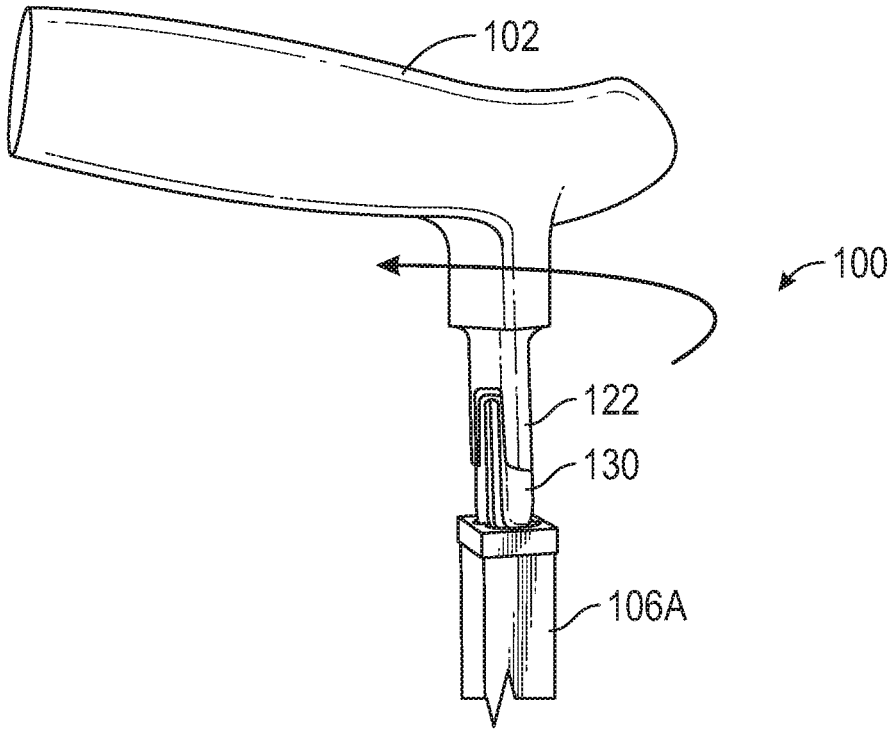
FIG. 11B is a perspective view of the handle of FIG. 1 in a rotated position.
Figure 11C:
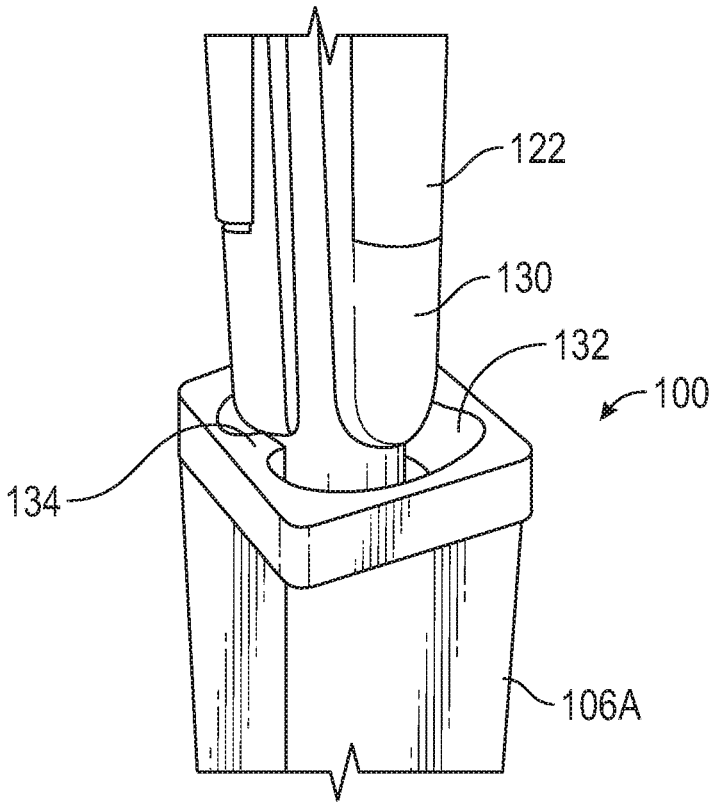
FIG. 11C is a perspective view of a portion of the handle of FIG. 1 in the rotated position.

Referring to FIGS. 1, 2A-B, 3, and 9, in various aspects, the handle 102 is ergonomically shaped for a comfortable and stable grip. In certain examples, the handle 102 is connected to the top-most cane segment 106 (e.g., cane segment 106A) through a hinged portion 130 of the handle anchoring member 122 such that the handle 102 can be folded relative to the top-most cane segment 106 (see, e.g., FIG. 2B). Referring to FIGS. 11A-C, in some optional examples, in addition to being foldable, the handle 102 may also be rotatable relative to the top-most cane segment 106. In such examples, the top-most cane segment 106 may include a tab 134 and groove 132 that predefine rotation positions of the handle 102. In other examples, a profile of the cane segment 106 may limit the amount of handle rotation.

Figure 9:
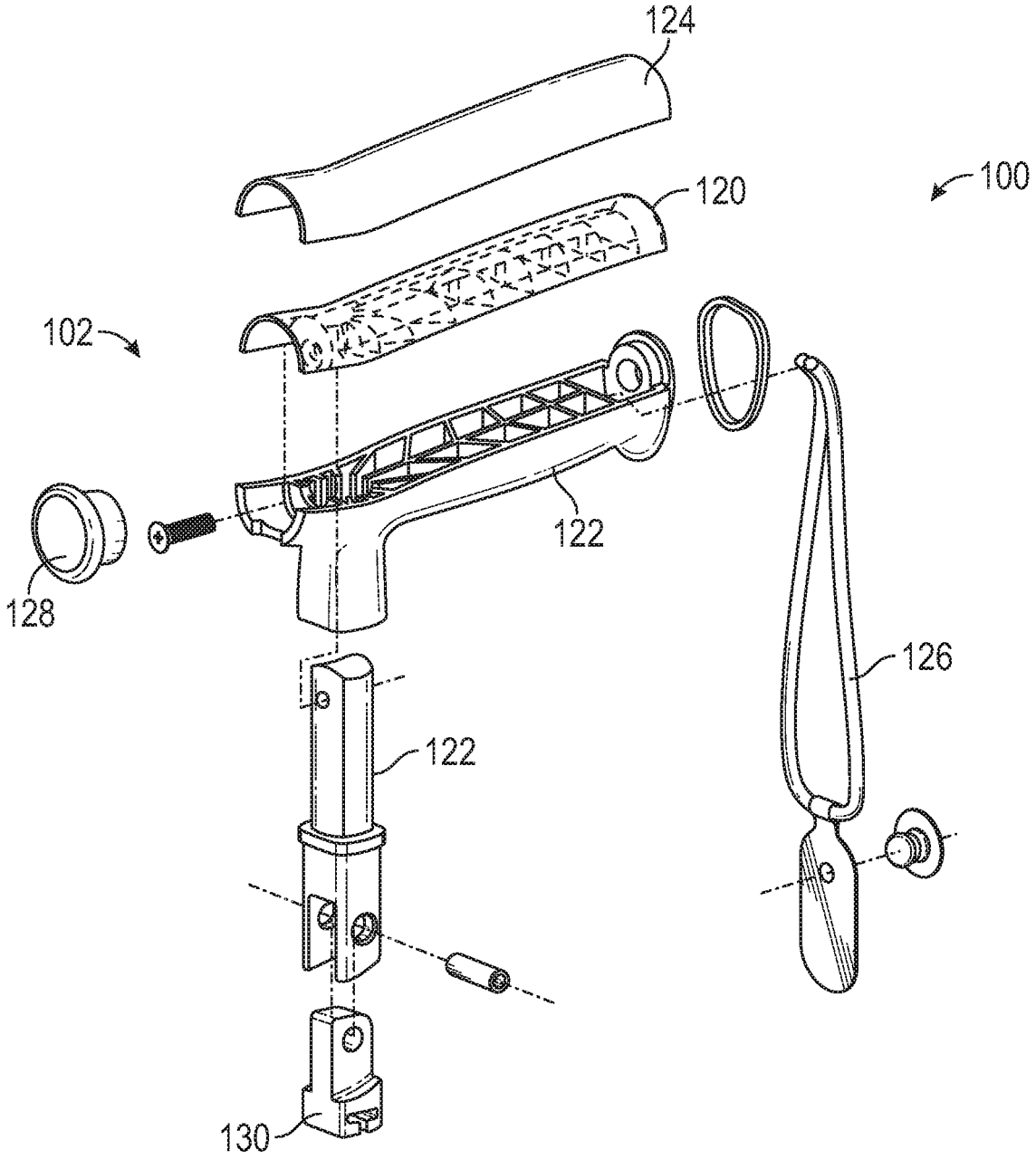
FIG. 9 is an exploded assembly view of another portion of the folding cane of FIG. 1.

As illustrated in FIG. 9, in certain cases, the handle 102 optionally includes a top shell 121 and a bottom shell 123. Optionally, an overmold 124 is provided on the top shell 121. In some optional examples, the handle 102 includes a strap 126 that can be placed around the wrist of the user when the cane 100 is in its unfolded configuration. The strap 126 may optionally be used to organize and retain the segments 106 of the cane 100 when the cane 100 is in its folded configuration. In certain examples, the handle 102 accommodates one or more accessory modules 128 that are removable and replaceable as desired by the user. In some aspects, the accessory module 128 includes, but is not limited to, a flashlight, fitness tracker, GPS finder, music player, release button, sensor, or various other accessory modules as desired.

Figure 6:
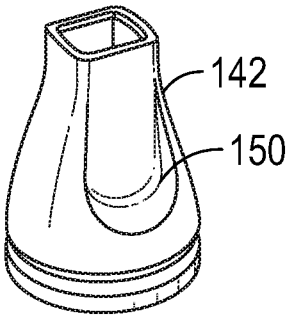
FIG. 6 is a perspective view of a foot according to aspects of the current disclosure that can be used with the folding cane of FIG. 1.
Figure 7A:
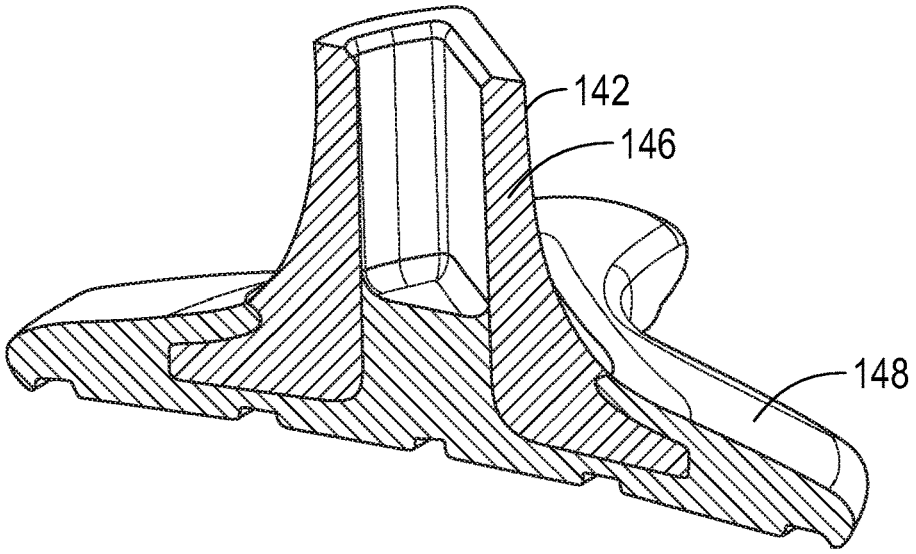
FIG. 7A is a sectional view of a foot of the folding cane of FIG. 1.
Figure 7B:
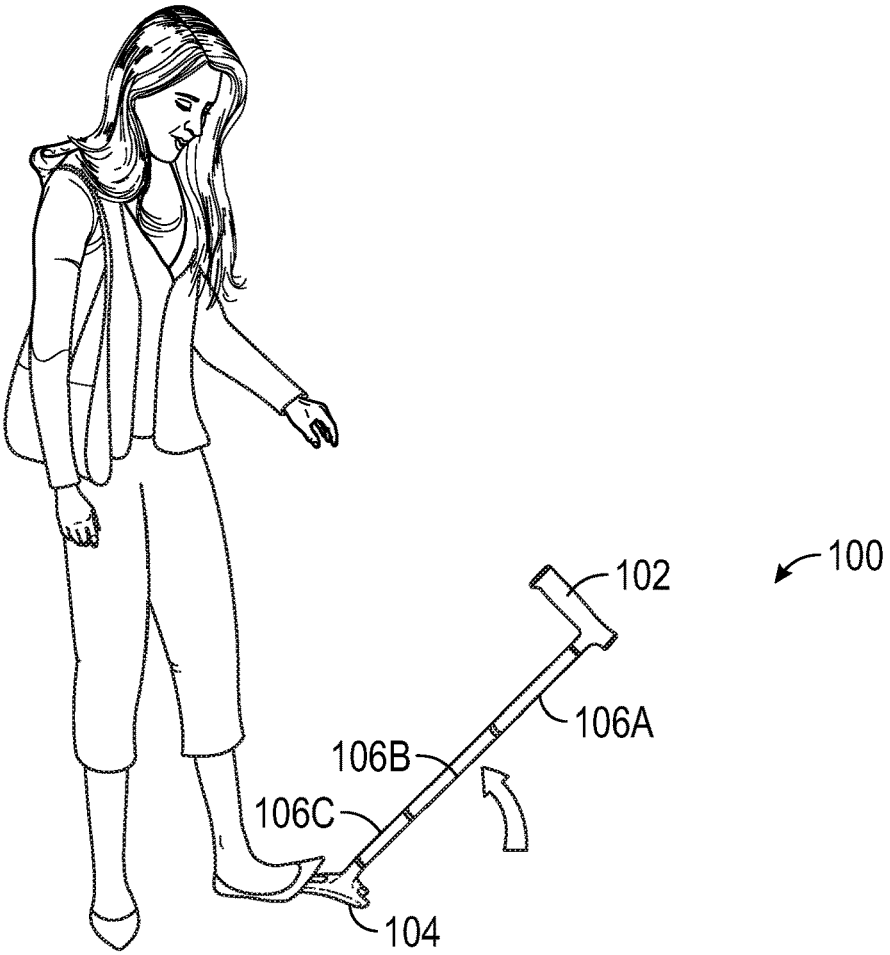
FIG. 7B is a perspective view of the folding cane of FIG. 1 tilted to a raised position for a user.

Referring to FIGS. 1, 2A-B, 3, 4, 5, and 7A-B, the tip 104 includes a removable foot 142. In certain aspects, the foot anchoring member 120 includes at least one slot 144 that is configured to selectively engage and secure the foot 142 on the cane segment. In some examples, the foot 142 is a self-standing foot 142 that is "X" shaped (or having any other suitable shape) such that the folding cane 100 stands upright on flat ground. In addition to being self-standing, in some examples, the foot 142 may be used as a step-lever to upright the folding cane 100 if the cane 100 has fallen on the ground (see FIG. 7B). Optionally, and as illustrated in FIG. 7A, the foot 142 may include a rigid material 146 and a flexible material 148. Optionally, the rigid material 146 forms the core of the foot 142 and the flexible material 148 forms the grip of the foot 142, although it need not. In other examples, as illustrated in FIG. 6, the foot 142 is a single tip foot 142.

Figure 5:
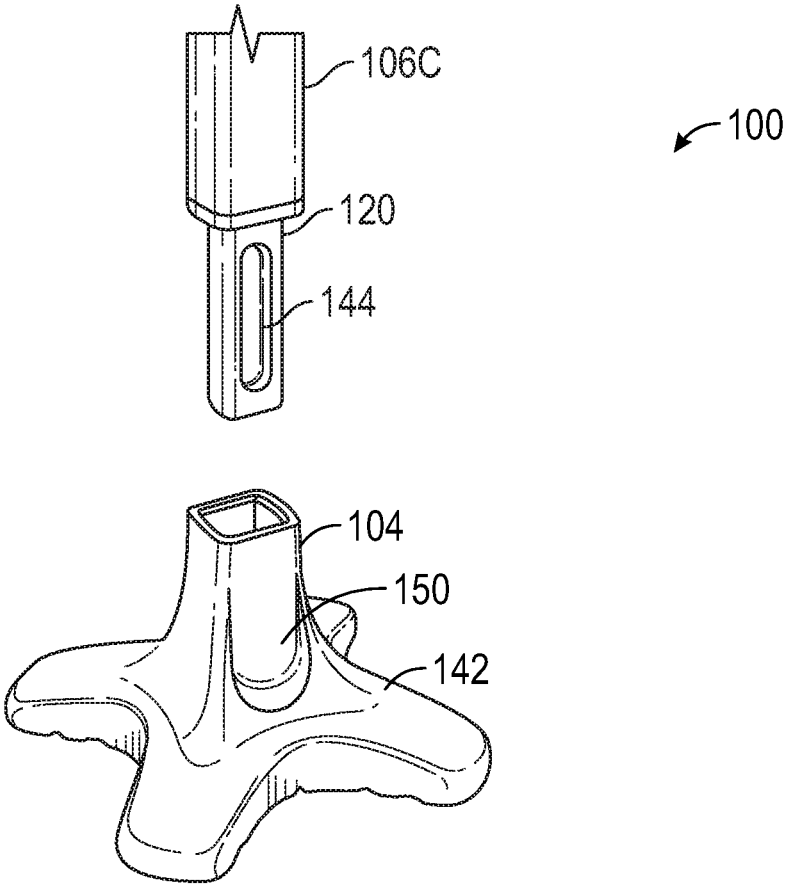
FIG. 5 is a perspective view of a portion of the folding cane of FIG. 1.

As illustrated in FIGS. 5 and 6, in some examples, the foot 142 includes a groove 150. In certain cases, the groove 150 may be utilized as a button to aid in removal of the foot 142 from the folding cane 100 (e.g., to replace the type of foot 142 on the folding cane 100). In various aspects, the groove 150 receives a portion of one of the cane segments 106 in the folded configuration such that the foot 142 nests with the collapsible cane segment 106. For example, FIG. 2B illustrates the foot 142 nested with the cane segment 106B.

FIGS. 12A-16 illustrate another example of a folding cane 1200. In some examples, the folding cane 1200 may be similar to the folding cane 100. In some aspects, compared to the cane segment 106 of the folding cane 100, the cane segment 106 of the folding cane 1200 has a different profile. For example, as illustrated in FIG. 12C, the cane segment 106 of the cane 1200 has a triangular profile and includes three nesting surfaces 108.

Figure 14A:
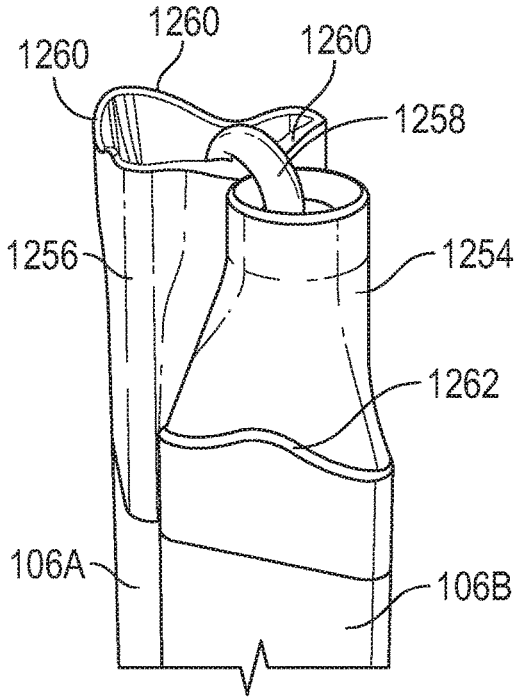
FIG. 14A is a perspective view of adjacent segments of the folding cane of FIG. 12A in the folded configuration.
Figure 14B:
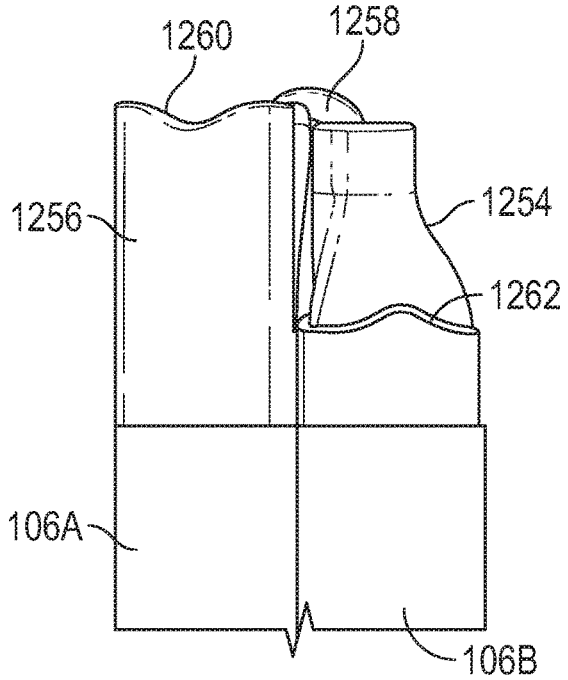
FIG. 14B is a perspective view of the adjacent segments of the folding cane of FIG. 12A in the folded configuration.
Figure 14C:
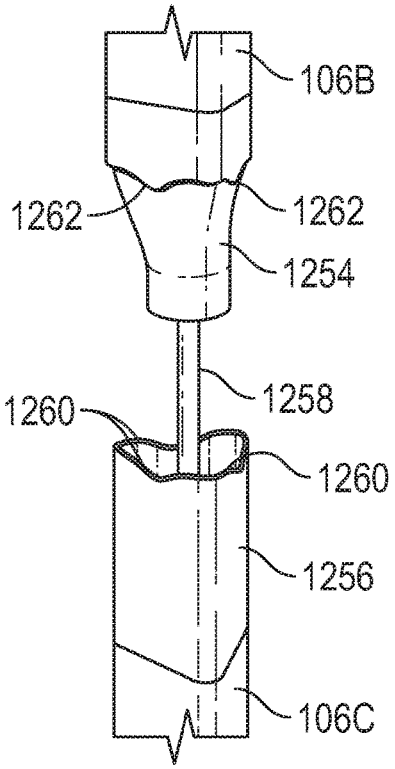
FIG. 14C is a perspective view of the adjacent segments of the folding cane of FIG. 12A in the unlocked position of the unfolded configuration.
Figure 15:
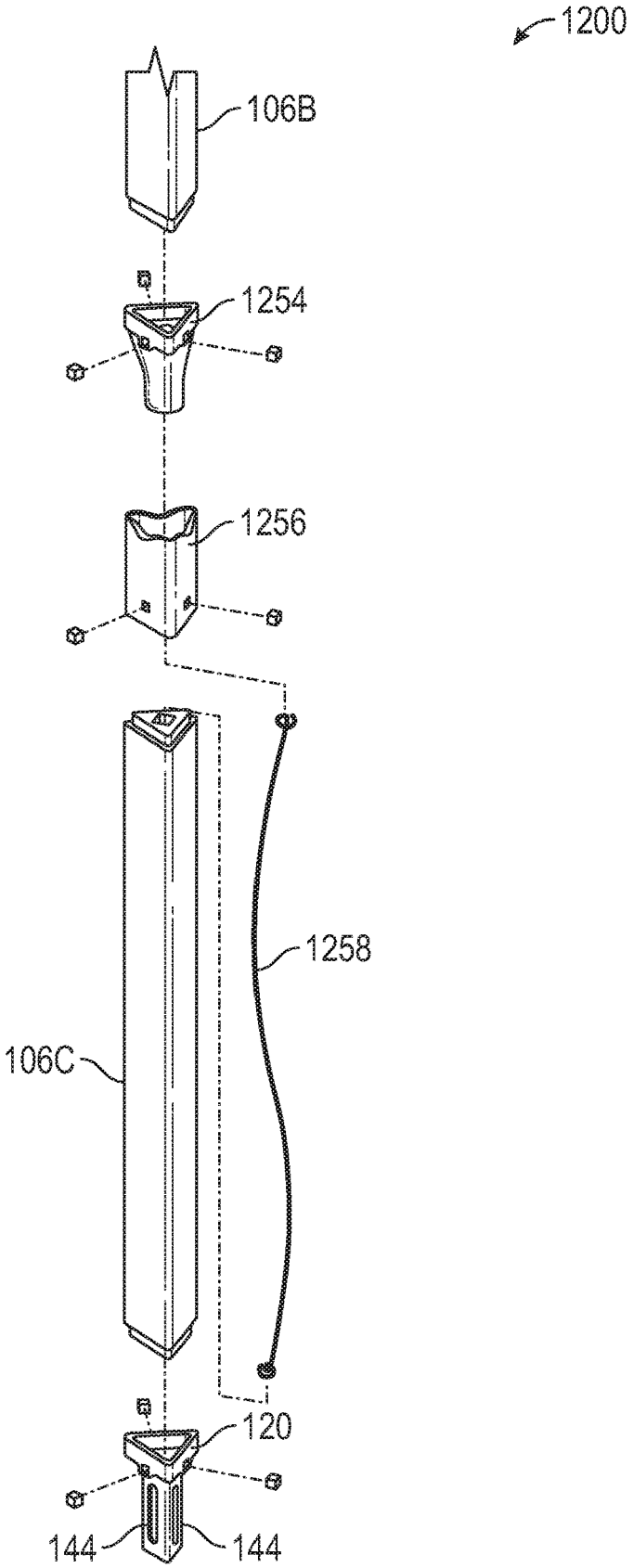
FIG. 15 is an exploded assembly view of a portion of the folding cane of FIG. 12A.
Figure 16:
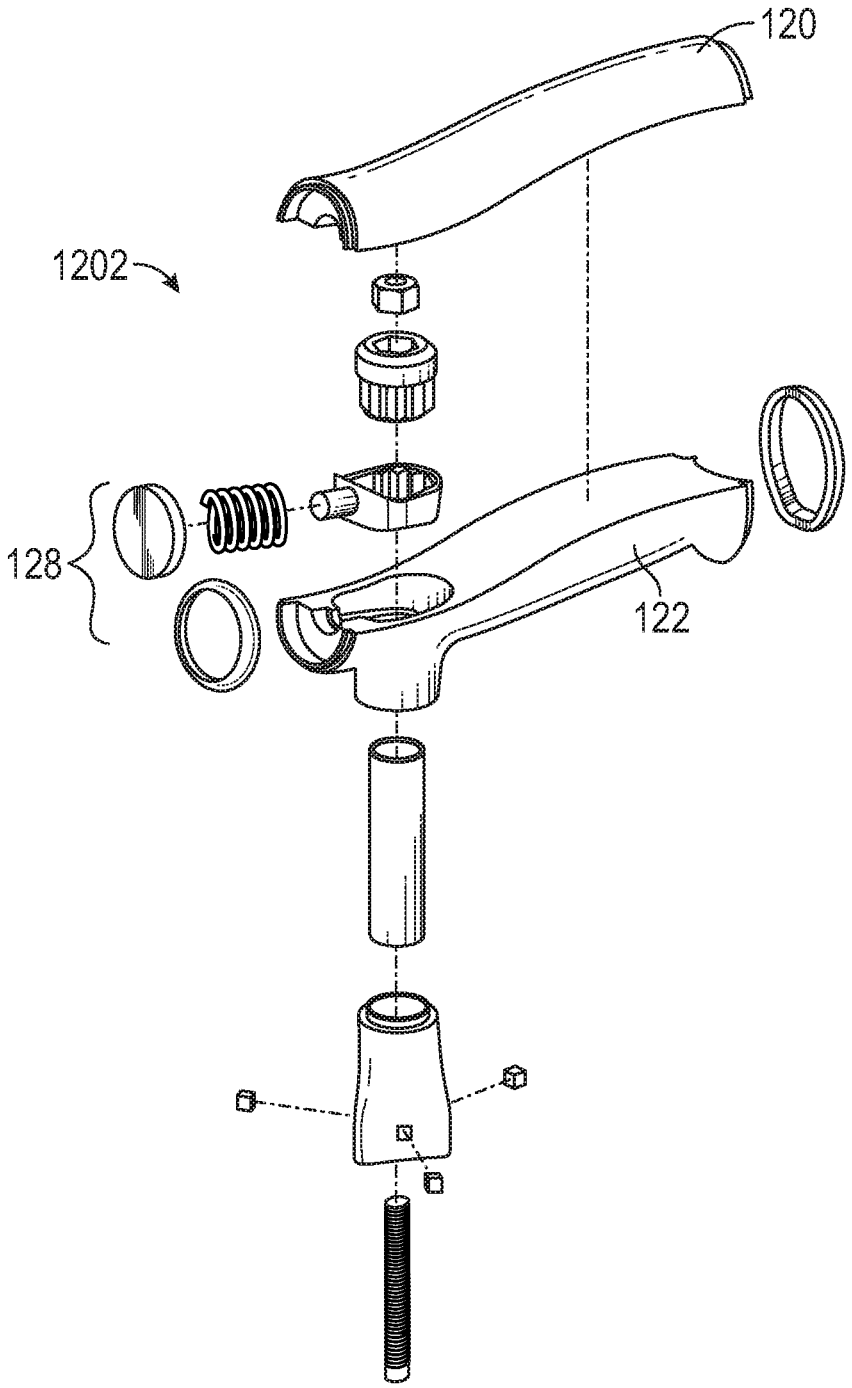
FIG. 16 is an exploded assembly view of another portion of the folding cane of FIG. 12A.
Figure 17A:
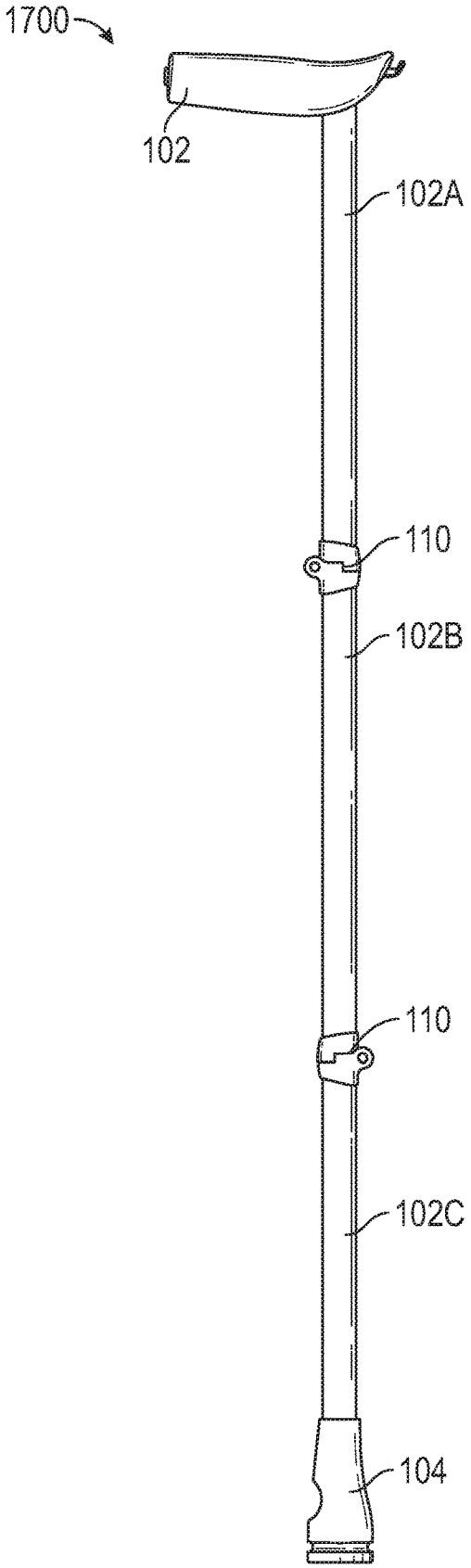
FIG. 17A is a side view of a folding cane according to aspects of the current disclosure in an unfolded configuration.
Figure 17B:
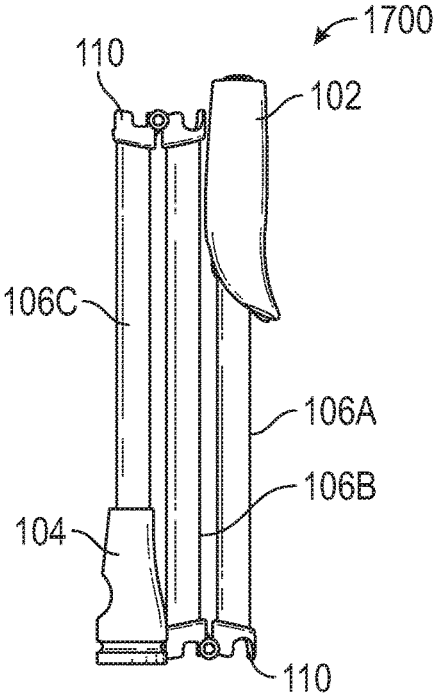
FIG. 17B is a side view of the folding cane of FIG. 17A in a folded configuration.
Figure 18A:
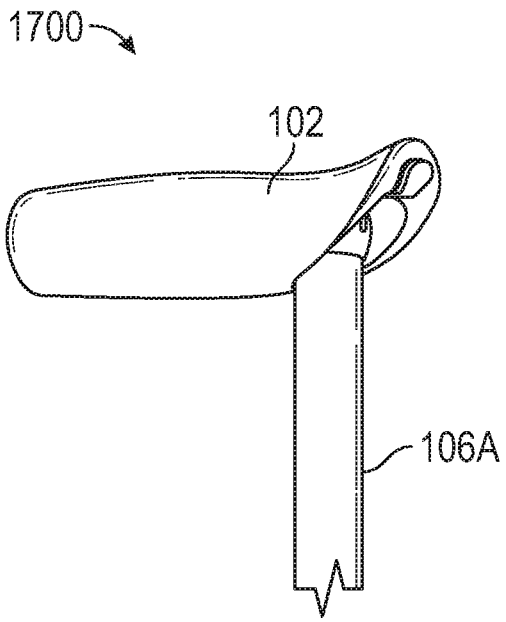
FIG. 18A is a perspective view of the handle of the folding cane of FIG. 17A in the unfolded configuration.
Figure 18B:
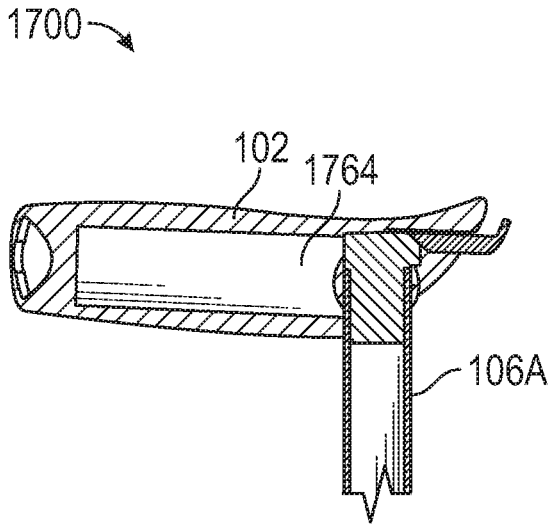
FIG. 18B is a sectional view of the handle of the folding cane of FIG. 17A in the unfolded configuration.
Figure 19A:
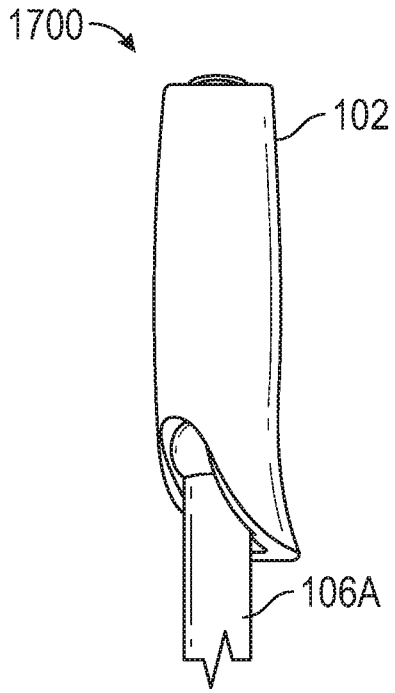
FIG. 19A is a perspective view of the handle of the folding cane of FIG. 17A in the folded configuration.
Figure 19B:
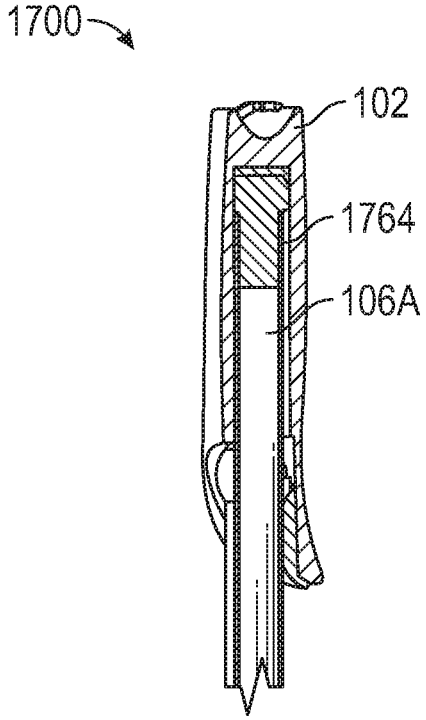
FIG. 19B is a sectional view of the handle of the folding cane of FIG. 17A in the folded configuration.
Figure 20:
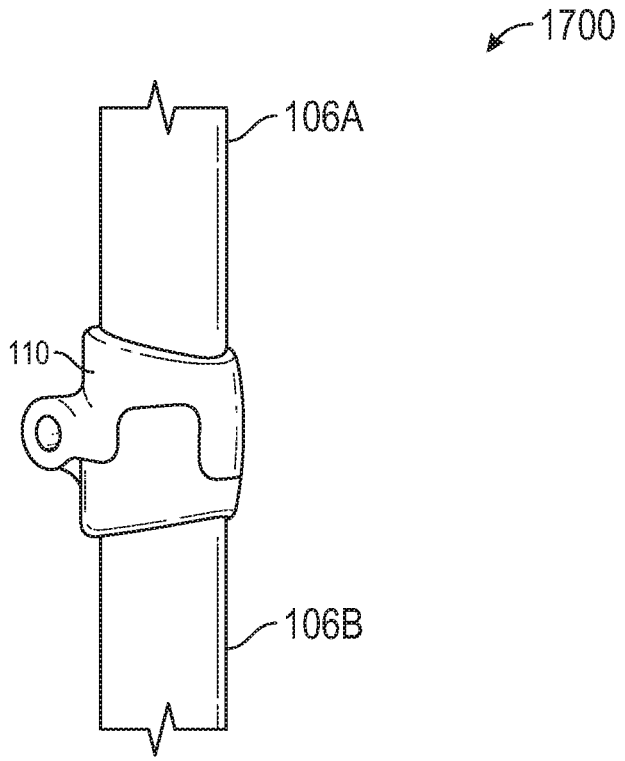
FIG. 20 is a perspective view of adjacent segments of the folding cane of FIG. 17A in the unfolded configuration.
Figure 21:
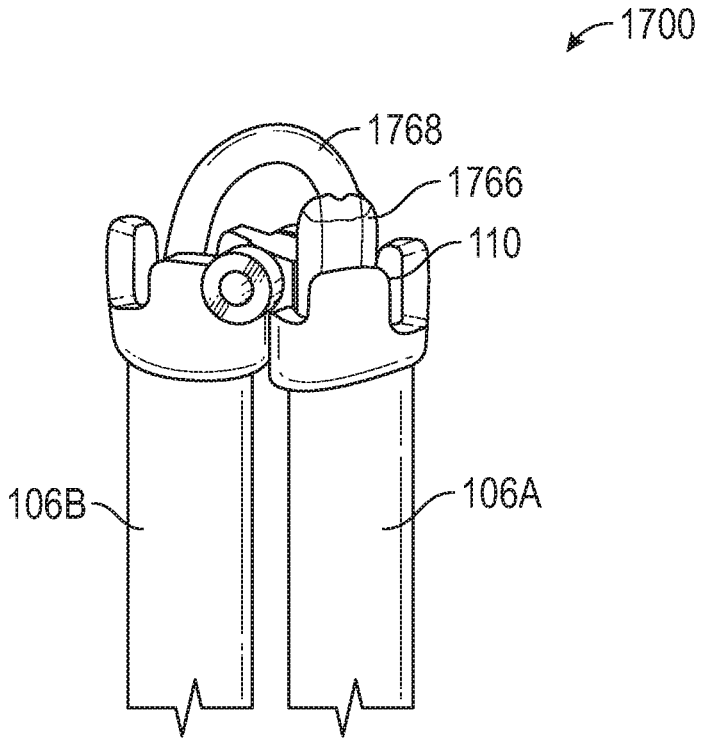
FIG. 21 is a perspective view of adjacent segments of the folding cane of FIG. 17A in the folded configuration.

In various cases, instead of the hinges 110, the folding cane 1200 includes a connecting system 1252 between adjacent cane segments 106. Compared to the connecting system of the folding cane 100, the connecting system 1252 includes a male connector 1254 and a female connector 1256 connected by a shock cord 1258 (or other suitable member). As best illustrated in FIGS. 14A-C, the female connector 1256 includes at least one shock cord notch 1260. In the folded configuration, a portion of the shock cord 1258 is positionable within the shock cord notch 1260. In some examples, the male connector 1254 includes a ridge 1262, and, in the unfolded configuration, the ridge 1262 is retained in the shock cord notch 1260.

Figure 13A:
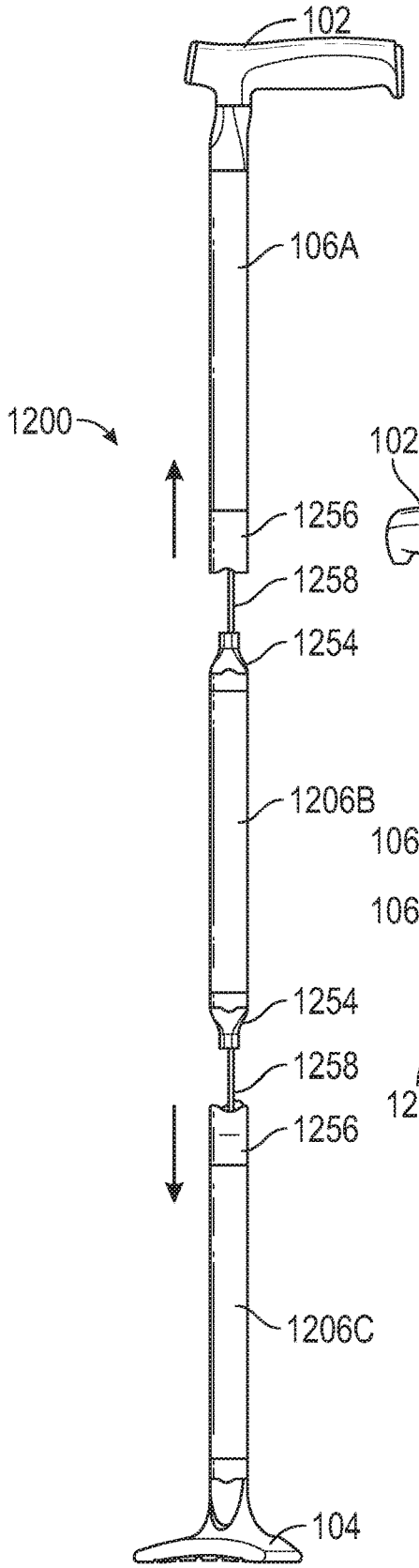
FIG. 13A is a side view of the folding cane of FIG. 12A in an unlocked position of the unfolded configuration.
Figure 13B:
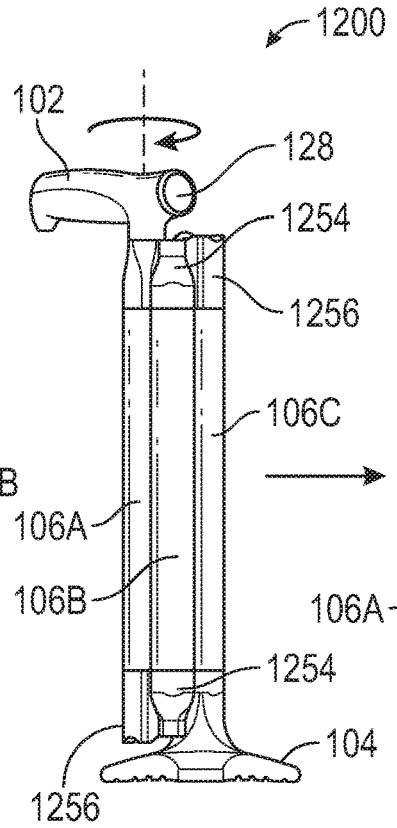
FIG. 13B is a side view of the folding cane of FIG. 12A in the folded configuration with the handle in a first position.
Figure 13C:
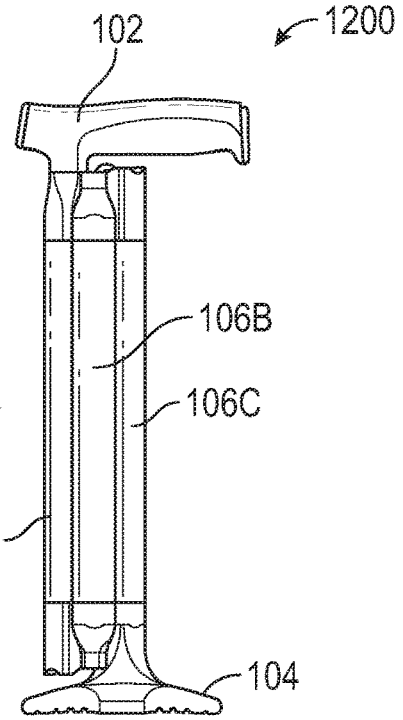
FIG. 13C is a side view of the folding cane of FIG. 12A in the folded configuration with the handle in a second position.

As illustrated in FIGS. 13B-C, compared to the handle 102 of the folding cane 100, the handle 102 of the folding cane 1200 is rotatable about an axis of at least one of the cane segments 106. It will be appreciated that when the folded cane 1200 (or folding cane 100) is in the unfolded configuration, the axes of the cane segments 106 align. In the cane 1200, the accessory module 128 is a release button (see FIG. 16); however in other examples, additional and/or different accessory modules 128 may be utilized with the handle 102.

Figure 22A:
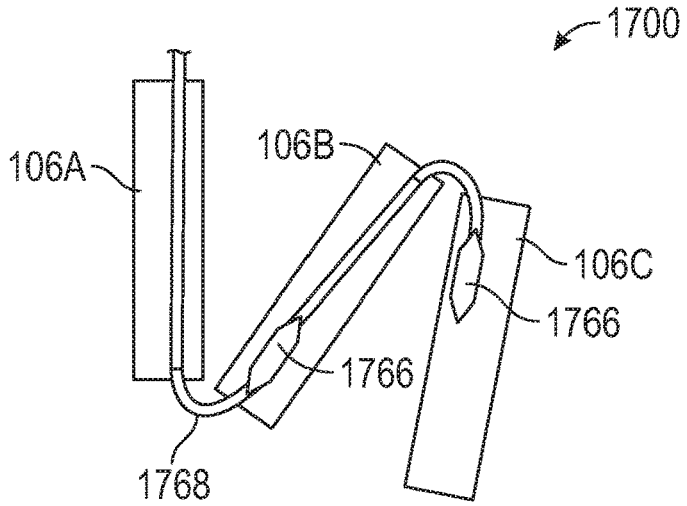
FIG. 22A illustrates segments of the folding cane of FIG. 17A in a folded configuration.
Figure 22B:
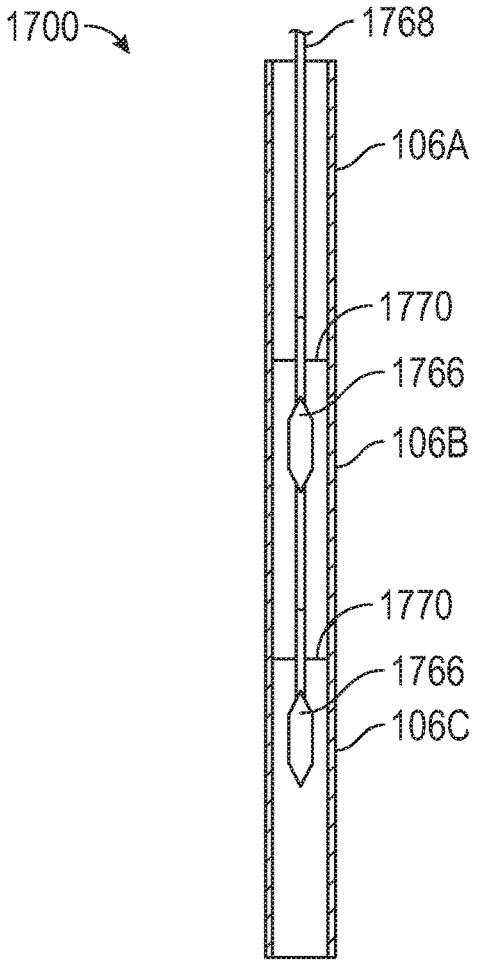
FIG. 22B illustrates the segments of the folding cane of FIG. 17A in an unlocked position of an unfolded configuration.
Figure 22C:
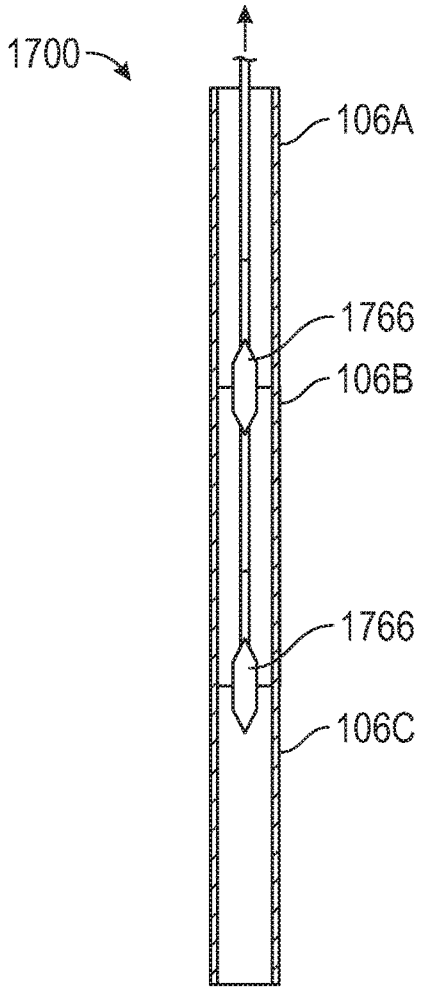
FIG. 22C illustrates the segments of the folding cane of FIG. 17A in a locked position of the unfolded configuration.

FIGS. 17A-22C illustrate another example of a folding cane 1700. Compared to the folding cane 100, the connecting system of the folding cane 1700 includes hinges 110 that are uni-directional. In addition, compared to the folding cane 100, the hinges 110 of the folding cane 1700 are not concealed within one or more of the cane segments 106 in the unfolded configuration. Optionally, a barrel lock comprising at least one barrel 1766 and a flexible cord 1768 connects the handle 102 to each hinge 110. As illustrated in FIG. 22A, in the folded configuration, the barrels 1766 are positioned within the respective cane segments 106. In FIG. 22B, the cane 1700 is in the unfolded configuration and the barrels 1766 are in an unlocked position (i.e., they are offset from the center 1770 of the hinges 110 (not shown) such that the cane segments 106 can be folded). In FIG. 22C, the cane 1700 is in the unfolded configuration and the barrels 1766 are in a locked position (i.e., they overlap the center 1770 of the hinges 110 (not shown) such that the cane segments 106 cannot be folded). In some examples, compared to the handle 102 of the folding cane 100, the handle 102 of the folding cane 1700 defines a handle cavity 1764 that receives a portion of the cane segment 106A in the folded configuration (see, e.g., FIGS. 19A-B).

Figure 23A:
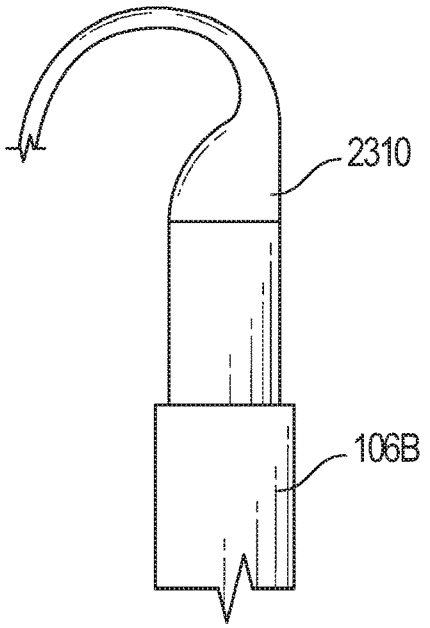
FIG. 23A illustrates a segment of a folding cane and a connecting member according to aspects of the current disclosure in a folded configuration.
Figure 23B:
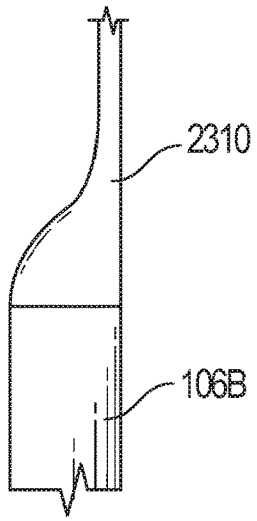
FIG. 23B illustrates the segment and connecting member of FIG. 23A in an unfolded configuration.

FIGS. 23A-B illustrate another example of a connecting system for joining adjacent cane segments 106 (although only one cane segment 106 is illustrated in the figures). As illustrated, the connecting system includes a flexible hinge 2310 with no pivot points; instead, a shape and material forming the flexible hinge 2310 allows for the flexible hinge 2310 (and thus the cane segments 106) to be foldable in at least two planes. In the example of FIGS. 23A-B, the flexible hinge 2310 is foldable in a single direction.

Figure 24A:
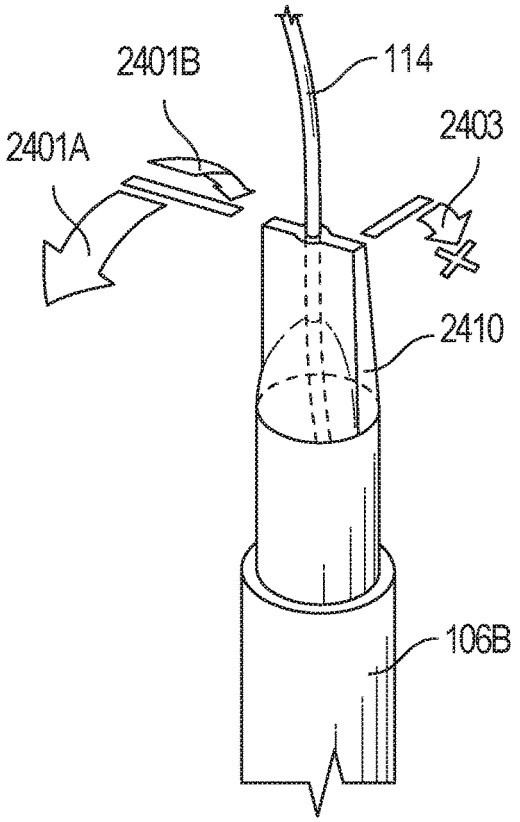
FIG. 24A illustrates a segment of a folding cane and a connecting member according to aspects of the current disclosure in an unfolded configuration.
Figure 24B:
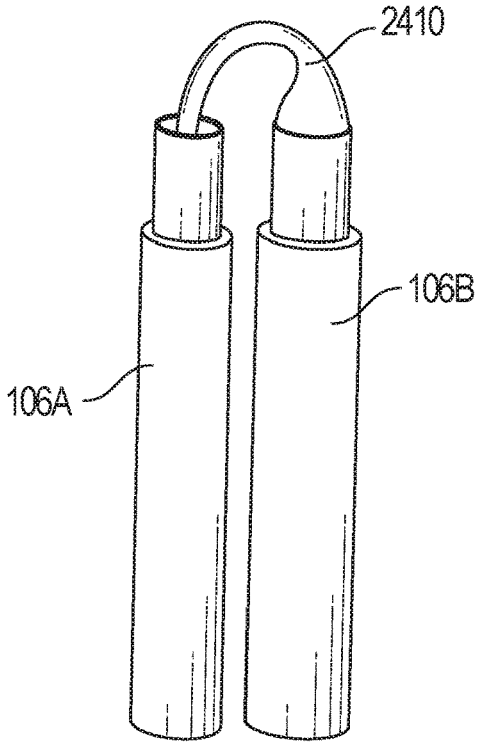
FIG. 24B illustrates the segment and connecting member of FIG. 24A in a folded configuration.

FIGS. 24A-B illustrate another example of a connecting system for joining adjacent cane segments 106. As illustrated, the connecting system includes a flexible hinge 2410 with no pivot points that is similar to the flexible hinge 2310. Compared to the flexible hinge 2310, the flexible hinge 2410 is optionally foldable in two opposing directions from the unfolded position (see arrows 2401A-B) but not in perpendicular directions (see arrow 2403). As a non-limiting example, the flexible hinge 2410 is foldable side-to-side, but not front-to-back (or vice versa).

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A compact and collapsible cane, comprising: (a) a handle; (b) a tip; and (c) at least two collapsible cane segments joining the handle to the tip, the cane segments configurable in an unfolded configuration and a folded configuration, wherein, in the folded configuration, a flat or nesting surface extending along a portion of one of the cane segments abuts a corresponding flat or nesting surface extending along a portion of an adjacent cane segment.

EC 2. The compact and collapsible cane of any of the preceding or subsequent example combinations, wherein the cane segments have non-circular cross-sectional profiles.

EC 3. The compact and collapsible cane of any of the preceding or subsequent example combinations, wherein the cross-sectional profiles of the cane segments each include at least one flat surface.

EC 4. The compact and collapsible cane of any of the preceding or subsequent example combinations, further comprising a hinge between the two collapsible cane segments, the hinge comprising two parallel pivot axes, wherein the cane segments are configurable between the unfolded configuration and the folded configuration by moving the cane segments apart from one another to expose a portion of the hinge, and rotating the cane segments relative to one another about the two pivot axes.

EC 5. The compact and collapsible cane of any of the preceding or subsequent example combinations, wherein the hinge is a first hinge, and wherein the cane further comprises a second hinge at an end of one of the cane segments opposite from the first hinge, and wherein an elastic member connects the first hinge to the second hinge.

EC 6. The compact and collapsible cane of any of the preceding or subsequent example combinations, wherein at least one of the cane segments comprises a magnet configured to facilitate retaining the cane in the folded configuration.

EC 7. The compact and collapsible cane of any of the preceding or subsequent example combinations, wherein the tip comprises a removable foot, and wherein the removable foot comprises a shape configured to receive a portion of one of the at least two collapsible cane segments in the folded configuration such that the removable foot nests with the one of the at least two collapsible cane segments.

EC 8. The compact and collapsible cane of any of the preceding or subsequent example combinations, wherein the shape of the removable foot comprises a groove, the groove configurable to detach the removable foot from the tip.

EC 9. A collapsible cane, comprising: (a) a handle; (b) a tip; (c) at least two collapsible cane segments joining the handle to the tip; and (d) a connecting system connecting the at least two collapsible cane segments, connecting system comprising a hinge, the hinge comprising at least one pivot axis, wherein the cane segments are configurable between an unfolded configuration and a folded configuration by moving the cane segments apart from one another, and rotating the cane segments relative to one another about the at least one pivot axis.

EC 10. The collapsible cane of any of the preceding or subsequent example combinations, wherein the hinge comprises two parallel pivot axes, and wherein the cane segments are configurable between the unfolded configuration and the folded configuration by moving the cane segments apart from one another to expose a portion of the hinge, and rotating the cane segments relative to one another about the two pivot axes.

EC 11. The collapsible cane of any of the preceding or subsequent example combinations, wherein the two parallel pivot axes are spaced apart such that the two cane segments can lie flush along one another.

EC 12. The collapsible cane of any of the preceding or subsequent example combinations, wherein the hinge is a first hinge, and wherein the cane further comprises a second hinge at an end of one of the cane segments opposite from the first hinge, and wherein an elastic member connects the first hinge to the second hinge.

EC 13. The collapsible cane of any of the preceding or subsequent example combinations, wherein, in the unfolded configuration, a portion of the hinge is housed in one of the at least two collapsible cane segments.

EC 14. The collapsible cane of any of the preceding or subsequent example combinations, wherein, in the unfolded configuration, a portion of the hinge is housed in both of the at least two collapsible cane segments.

EC 15. The collapsible cane of any of the preceding or subsequent example combinations, wherein, in the folded configuration, a flat or nesting surface of one of the cane segments abuts a corresponding flat or nesting surface of an adjacent cane segment.

EC 16. The collapsible cane of any of the preceding or subsequent example combinations, wherein the one of the at least two collapsible cane segments comprises a locking collar, the locking collar comprises at least one locking tab, and wherein the hinge comprises at least one locking notch configured to engage the at least one locking tab in the folded configuration.

EC 17. A collapsible cane, comprising: (a) a handle; (b) a tip; (c) at least two collapsible cane segments joining the handle to the tip; and (d) a connector system between the two collapsible cane segments, the connector system comprising a male connector, a female connector, and an elastic member, wherein the female connector comprises at least one elastic member notch, and wherein the cane segments are configurable between an unfolded configuration and a folded configuration by moving the cane segments apart from one another to remove the male connector from the female connector, and rotating the cane segments relative to one another while a portion of the elastic member is positioned in the notch.

EC 18. The collapsible cane of any of the preceding or subsequent example combinations, wherein, in the folded configuration, a flat or nesting surface of one of the cane segments abuts a corresponding flat or nesting surface of an adjacent cane segment.

EC 19. The collapsible cane of any of the preceding or subsequent example combinations, wherein the connector system comprises an anti-rotation system, and wherein, in the unfolded configuration, the segments connected by the connector system cannot rotate independently of one another.

EC 20. The collapsible cane of any of the preceding or subsequent example combinations, wherein the handle is shaped to nest with a portion of one of the cane segments in the folded configuration.

EC 21. The collapsible cane of any of the preceding or subsequent example combinations, wherein the handle is foldable relative to the cane segments.

EC 22. A collapsible cane, comprising: (a) a handle; (b) a tip; (c) at least two collapsible cane segments joining the handle to the tip; and (d) a connector system between the two collapsible cane segments, the connector system comprising an anti-rotation system, wherein the cane segments are configurable between an unfolded configuration and a folded configuration by moving the cane segments apart from one another and rotating the cane segments relative to one another, and wherein in the unfolded configuration, the anti-rotation system maintains an angular position of one of the cane segments relative to an adjacent cane segment.

EC 23. The collapsible cane of any of the preceding or subsequent example combinations, wherein, in the folded configuration, a flat or nesting surface of one of the cane segments abuts a corresponding flat or nesting surface of an adjacent cane segment.

EC 24. The collapsible cane of any of the preceding or subsequent example combinations, wherein the connector system comprises a male connector, a female connector, and an elastic member, wherein the female member comprises at least one locking notch, wherein the male connector further comprises at least one anti-rotation protrusion, and wherein, in the unfolded configuration, the protrusion is positioned in the notch.

EC 25. The collapsible cane of any of the preceding or subsequent example combinations, wherein the cane segments are configurable between the unfolded configuration and the folded configuration by moving the cane segments apart from one another to remove the male connector from the female connector, and rotating the cane segments relative to one another while a portion of the elastic member is positioned in the notch EC 26. The collapsible cane of any of the preceding or subsequent example combinations, wherein the handle is foldable relative to an adjacent cane segment.

EC 27. A compact and collapsible cane, comprising: (a) a collapsible handle; (b) a tip; and (c) at least two collapsible cane segments joining the handle to the tip, wherein the cane segments and handle are configurable between an unfolded configuration and a folded configuration by moving the cane segments apart from one another, rotating the cane segments relative to one another, and rotating the handle relative to one of the cane segments.

EC 28. The collapsible cane of any of the preceding or subsequent example combinations, wherein, in the folded configuration, a flat or nesting surface of one of the cane segments abuts a corresponding flat or nesting surface of an adjacent cane segment.

EC 29. The compact and collapsible cane of any of the preceding or subsequent example combinations, wherein the cane segments have non-circular cross-sectional profiles.

EC 30. The compact and collapsible cane of any of the preceding or subsequent example combinations, wherein the cross-sectional profiles of the cane segments each include at least one flat surface.

EC 31. The compact and collapsible cane of any of the preceding or subsequent example combinations, further comprising a hinge between the two collapsible cane segments, the hinge comprising two parallel pivot axes, wherein the cane segments are configurable between the unfolded configuration and the folded configuration by moving the cane segments apart from one another to expose a portion of the hinge, and rotating the cane segments relative to one another about the two pivot axes.

EC 32. The compact and collapsible cane of any of the preceding or subsequent example combinations, wherein the hinge is a first hinge, and wherein the cane further comprises a second hinge at an end of one of the cane segments opposite from the first hinge, and wherein an elastic member connects the first hinge to the second hinge.

EC 33. The collapsible cane of any of the preceding or subsequent example combinations, wherein the hinge comprises a single axis of rotation.

EC 34. A compact and collapsible cane, comprising: (a) a collapsible handle; (b) a tip; and (c) at least three collapsible cane segments joining the handle to the tip, wherein the cane segments, are configurable between an unfolded configuration and a folded configuration by moving the cane segments apart from one another with a single linear motion, and rotating the cane segments relative to one another.

EC 35. The collapsible cane of any of the preceding or subsequent example combinations, wherein, in the folded configuration, a flat or nesting surface of one of the cane segments abuts a corresponding flat or nesting surface of an adjacent cane segment.

EC 36. The compact and collapsible cane of any of the preceding or subsequent example combinations, wherein the cane segments have non-circular cross-sectional profiles.

EC 37. The compact and collapsible cane of any of the preceding or subsequent example combinations, wherein the cross-sectional profiles of the cane segments is triangular.

EC 38. The compact and collapsible cane of any of the preceding or subsequent example combinations, further comprising a hinge between the two collapsible cane segments, the hinge comprising two parallel pivot axes, wherein the cane segments are configurable between the unfolded configuration and the folded configuration by moving the cane segments apart from one another to expose a portion of the hinge, and rotating the cane segments relative to one another about the two pivot axes.

EC 39. The compact and collapsible cane of any of the preceding or subsequent example combinations, wherein the single linear motion is along an axis of the cane segments.

EC 40. The compact and collapsible cane of any of the preceding or subsequent example combinations, wherein the handle is foldable relative to at least one of the cane segments.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

The invention claimed is:

1. A compact and collapsible cane, comprising:

(a) a handle;

(b) a tip; and (c) at least two collapsible cane segments joining the handle to the tip, the cane segments configurable in an unfolded configuration and a folded configuration, wherein, in the folded configuration, a flat or nesting surface extending along a portion of one of the cane segments abuts a corresponding flat or nesting surface extending along a portion of an adjacent cane segment, wherein the cane further comprises a hinge between the cane segments, the hinge comprising two parallel pivot axes, wherein the cane segments are configurable between the unfolded configuration and the folded configuration by moving the cane segments apart from one another to expose a portion of the hinge, and rotating the cane segments relative to one another about the two pivot axes, and wherein the hinge is a first hinge, wherein the compact and collapsible cane further comprises a second hinge at an end of one of the cane segments opposite from the first hinge, and wherein an elastic member connects the first hinge to the second hinge.

2. The compact and collapsible cane of claim 1, wherein the cane segments have non-circular cross-sectional profiles.

3. The compact and collapsible cane of claim 2, wherein the cross-sectional profiles of the cane segments each include at least one flat surface.

4. The compact and collapsible cane of claim 1, wherein the two parallel pivot axes are spaced apart such that the two cane segments can lie flush along one another.

5. The compact and collapsible cane of claim 1, wherein, in the unfolded configuration, a portion of the hinge is housed in one of the at least two collapsible cane segments.

6. The compact and collapsible cane of claim 1, wherein the tip comprises a removable foot, and wherein the removable foot comprises a shape configured to receive a portion of one of the at least two collapsible cane segments in the folded configuration such that the removable foot nests with the one of the at least two collapsible cane segments.

* * * * *